US008671859B2

(12) United States Patent
Kawaguchi et al.

(10) Patent No.: US 8,671,859 B2
(45) **Date of Patent: *Mar. 18, 2014**

(54) WORKPIECE HOLDER AND SEWING MACHINE

(75) Inventors: Yasuhiko Kawaguchi, Nagoya (JP); Tomoyasu Niizeki, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 823 days.

This patent is subject to a terminal disclaimer.

(21) Appl. No.: 12/873,808

(22) Filed: Sep. 1, 2010

(65) Prior Publication Data

US 2011/0056420 A1 Mar. 10, 2011

(30) Foreign Application Priority Data

Sep. 7, 2009 (JP) ..... 2009-205825

(51) Int. Cl.
*D05C 7/04* (2006.01)

(52) U.S. Cl.
USPC ..... 112/103

(58) Field of Classification Search
USPC ..... 112/102, 103, 104, 102.5, 118, 119, 112/475.04, 475.18
See application file for complete search history.

(56) References Cited

U.S. PATENT DOCUMENTS

| | | | | |
|---|---|---|---|---|
| 4,388,883 | A * | 6/1983 | Hirota et al. | 112/102.5 |
| 6,161,491 | A * | 12/2000 | Takenoya et al. | 112/102.5 |
| 6,820,565 | B1 | 11/2004 | Kawaguchi et al. | |
| 7,484,466 | B2 | 2/2009 | Kuki et al. | |
| 8,276,532 | B2 * | 10/2012 | Kawaguchi | 112/470.05 |

FOREIGN PATENT DOCUMENTS

| | | |
|---|---|---|
| JP | A 57-12156 | 1/1982 |
| JP | A 5-096071 | 4/1993 |
| JP | U-6-34830 | 5/1994 |
| JP | A-7-148534 | 6/1995 |
| JP | A 11-172566 | 6/1999 |
| JP | A 2002-052280 | 2/2002 |
| JP | A 2004-254987 | 9/2004 |
| JP | A 2005-146460 | 6/2005 |
| JP | A-2006-53417 | 2/2006 |
| JP | U-3130916 | 4/2007 |
| JP | A 2007-222189 | 9/2007 |
| JP | A-2008-280663 | 11/2008 |

OTHER PUBLICATIONS

U.S. Appl. No. 12/697,855, filed Feb. 1, 2010 in the name of Kawaguchi et al.
Notification of Reasons for Refusal dated Dec. 14, 2010 in corresponding Japanese Patent Application No. 2009-070255 (with translation).
Apr. 11, 2013 Office Action issued in U.S. Appl. No. 12/697,855.

* cited by examiner

*Primary Examiner* — Tejash Patel
(74) *Attorney, Agent, or Firm* — Oliff PLC

(57) ABSTRACT

A workpiece holder for use with an embroiderable sewing machine including a transfer device that transfers a workpiece in two predetermined directions, and a needle bar having a punch needle attached thereto, the workpiece holder being attached to the transfer device and holding a workpiece on which punch work is executed by the punch needle, the workpiece holder including a connecting element that is detachably attached to the transfer device; a placement element on which the workpiece is placed; a support element that is provided with the connecting element and that supports the placement element; a frame element that clamps the portions of the workpiece placed on the placement element exclusive of a workface on which the punch work is executed; and a retainer element that retains the frame element clamping the workpiece.

14 Claims, 19 Drawing Sheets

WORKPIECE HOLDER AND SEWING MACHINE

CROSS-REFERENCE TO RELATED APPLICATIONS

This application is based upon and claims the benefit of priority from the prior Japanese Patent Application 2009-205825, filed on Sep. 7, 2009, the entire contents of which are incorporated herein by reference.

FIELD

The present disclosure relates to a punch workpiece holder for use with an embroiderable sewing machine adapted to punch working a workpiece with a punch needle. The present disclosure also relates to a sewing machine allowing detachable attachment of such workpiece holder.

BACKGROUND

Conventionally, an embroidery frame transfer device is known that is detachably attached to a sewing machine to transfer an embroidery frame holding a workpiece cloth in X and Y directions for embroidering the workpiece cloth. One typical example of such embroidery frame transfer device is provided with a carriage that allows detachable attachment of the embroidery frame, an X-direction transfer mechanism that transfers the carriage in the X direction which extends in alignment with the lengthwise direction or the longer side of the sewing machine bed, a Y-direction transfer mechanism that transfers the carriage in the Y-direction orthogonal to the X direction. The embroidery frame holding the workpiece cloth is attached to the carriage. The desired embroidery pattern is formed on the workpiece by attaching the embroidery frame transfer device on the sewing machine and moving the carriage and the embroidery frame in the X and Y directions by way of the X-direction transfer mechanism and the Y-direction transfer mechanism under the control based on a predefined embroidery pattern data.

The inventors have conceived to utilize the above described embroiderable sewing machine for punch working the workpiece. To elaborate, the inventors have conceived of attaching a punch needle instead of a sewing needle to the needle bar of the above described sewing machine to utilize the sewing machine as a device for executing punch work. The workpiece is typically made of a sheet of paper or resin film and typical punch work being performed on the workpiece is cutting and pattern formation, etc. In such application, the needle bar having the punch needle attached to it is moved up and down while the workpiece is moved by the embroidery frame transfer mechanism based on a predefined punch data to create a predetermined punch work on the surface of the workpiece based on the data.

However, the workpiece on which the punch work is created is made of materials such as paper and resin film. Thus, the embroidery frame for holding a workpiece cloth cannot be utilized for holding the workpiece made of the above described materials. Such being the case, punch work requires a dedicated workpiece holder optimal for holding the workpiece.

SUMMARY

One object of the present disclosure is to provide a workpiece holder that is optimal for holding a workpiece in executing punch work on the workpiece using an embroiderable sewing machine and a sewing machine allowing detachable attachment of such workpiece holder.

According to a first aspect of the present disclosure, there is provided a workpiece holder for use with an embroiderable sewing machine including a transfer device that transfers a workpiece in two predetermined directions, and a needle bar having a punch needle attached thereto. The workpiece holder is attached to the transfer device and holds a workpiece on which punch work is executed by the punch needle. The workpiece holder includes a connecting element that is detachably attached to the transfer device; a placement element on which the workpiece is placed; a support element that is provided with the connecting element and that supports the placement element; a frame element that clamps the portions of the workpiece placed on the placement element exclusive of a workface on which the punch work is executed; and a retainer element that retains the clamping of the workpiece by the frame element.

According to a second aspect of the present disclosure, there is provided a workpiece holder for use with an embroiderable sewing machine including a transfer device that transfers a workpiece in two predetermined directions, and a needle bar having a punch needle attached thereto. The workpiece holder is attached to the transfer device and holds a workpiece on which punch work is executed by the punch needle. The workpiece includes a connecting element that is detachably attached to the transfer device; a placement element on which the workpiece is placed and that comprises an adhesive elastic element with a level of adhesiveness to allow detachable attachment of the workpiece placed thereon; and a support element that is provided with the connecting element and that supports the placement element.

According to a third aspect of the present disclosure, there is provided a workpiece holder for use with an embroiderable sewing machine including a transfer device that transfers a workpiece in two predetermined directions, and a needle bar having a punch needle attached thereto. The workpiece holder is attached to the transfer device and holds a workpiece on which punch work is executed by the punch needle. The workpiece holder includes a connecting element that is detachably attached to the transfer device; a frame element including a bottom panel on which the workpiece is placed, a top plate provided with an opening that exposes a workface of the workpiece on which punch work is executed, and a recess that is defined between the bottom panel and the top panel to receive removable insertion of the workpiece.

According to a fourth aspect of the present disclosure, there is provided a sewing machine allowing detachable attachment of the workpiece holder described in the first aspect. The connecting element of the workpiece holder is detachably attached to the transfer device. The sewing machine includes a controller, when cyclically executing identical punch work on a plurality of workpieces, that executes a dynamic mode in which the workpiece holder is moved upon each iteration of the cyclic execution of the identical punch work; wherein the controller, when executing the dynamic mode, controls the transfer device to move the workpiece holder such that the workpiece holder is moved by a predetermined distance prior to the punch work by the punch needle.

According to a fifth aspect of the present disclosure, there is provided a sewing machine allowing detachable attachment of the workpiece holder described in the first aspect. The connecting element of the workpiece holder is detachably attached to the transfer device. The sewing machine includes a presser foot drive mechanism that moves a presser foot up and down; a controller, when cyclically executing identical punch work on a plurality of workpieces, that executes a dynamic mode in which the workpiece holder is moved upon each iteration of the cyclic execution of the identical punch work; an engagement section provided at the placement element of the workpiece holder, and that is supported so as to be movable relative to the support element as well as being capable of engaging with the presser foot; a controller, when executing the dynamic mode, that controls the presser foot drive mechanism to lower the presser foot so as to be engaged with the engagement section of the placement element and that controls the transfer device to move the workpiece holder such that the support element is moved by a predetermined distance relative to the placement element engaged with the presser foot.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

A description will be given hereinafter on a first exemplary embodiment of the present disclosure with reference to FIGS. 1 to 15. Throughout the description given herein, the front-rear direction, the left-right direction, and the up-down direction designated in FIG. 1 denotes the front-rear direction or the Y direction, the left-right direction or the X direction, and the up-down direction or the Z direction relative to sewing machine 10. Sewing machine 10 is configured to be capable of creating punch work on a workpiece in addition to its inherent capability of sewing a workpiece cloth. In punch working, a workpiece is used that is made of a sheet of paper and resin material, etc., which is, for instance, less than 1 mm thick. Sewing machine 10 featured in the exemplary embodiments of the present disclosure is a household sewing machine. However, sewing machine 10 may comprise other types of sewing machines such as a multi-needle embroidery sewing machine for industrial applications.

Figure 1:
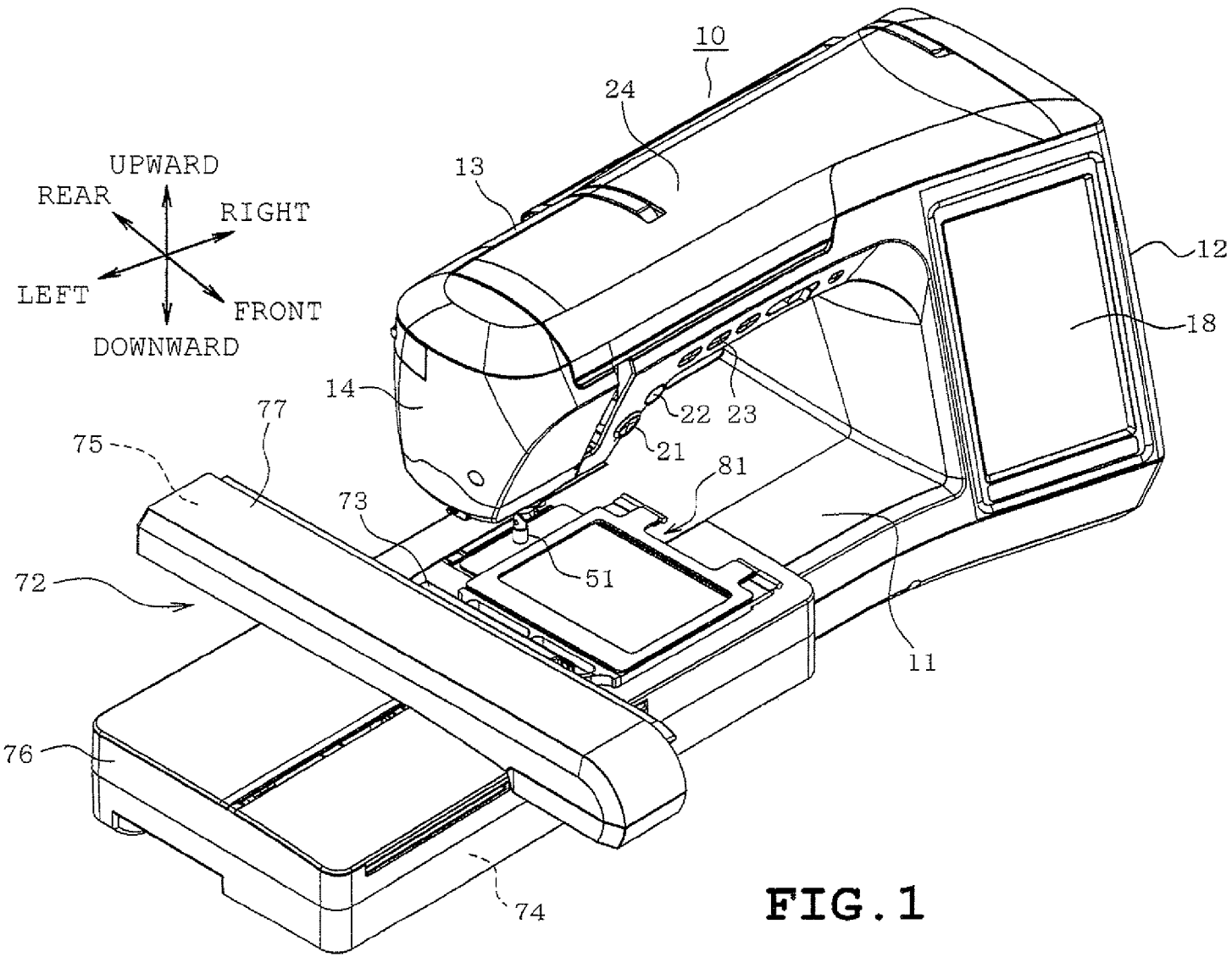
FIG. 1 is a general perspective view of a sewing machine according to a first exemplary embodiment of the present disclosure.
Figure 2:
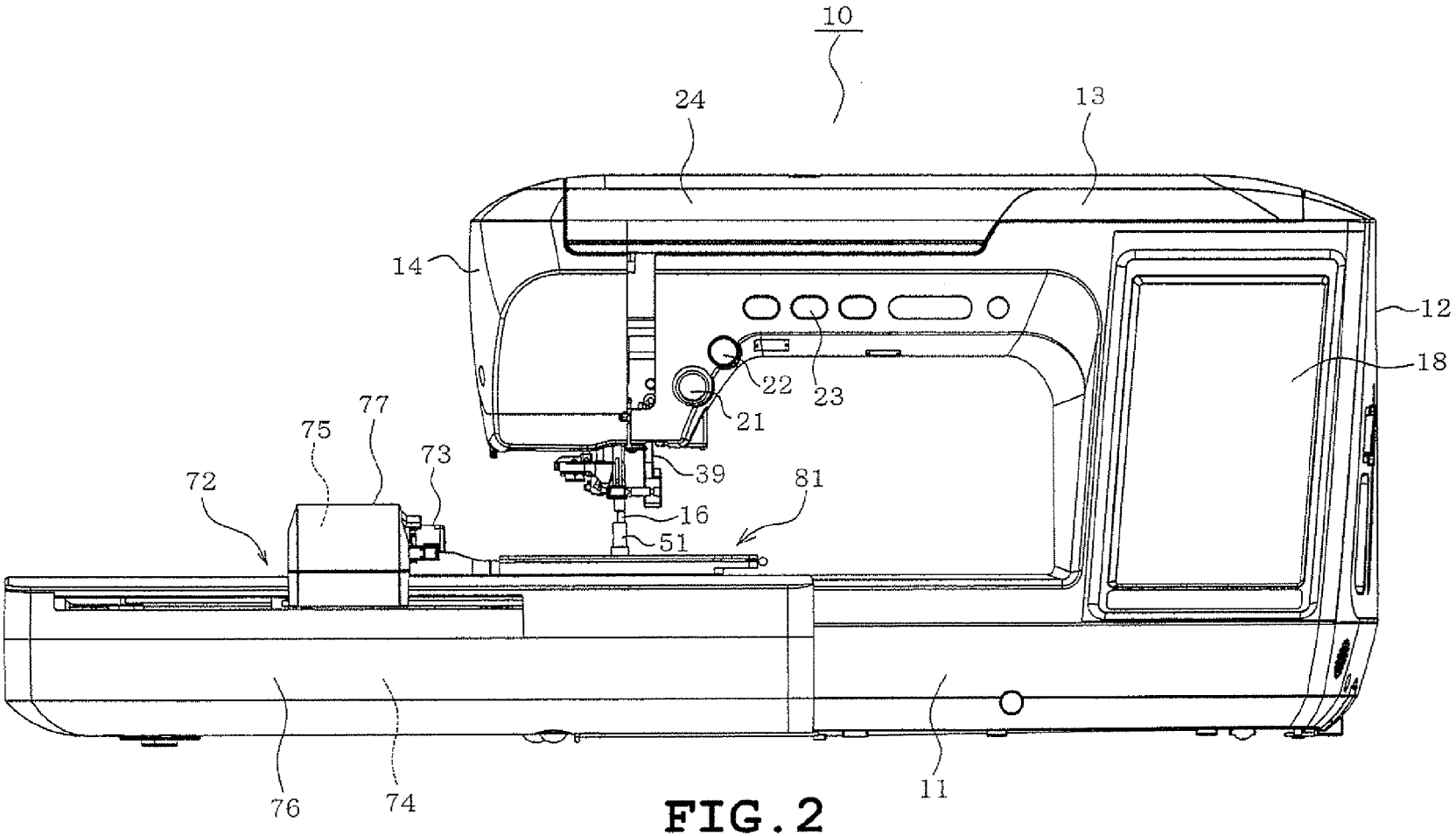
FIG. 2 is a front view of the sewing machine.
Figure 3:
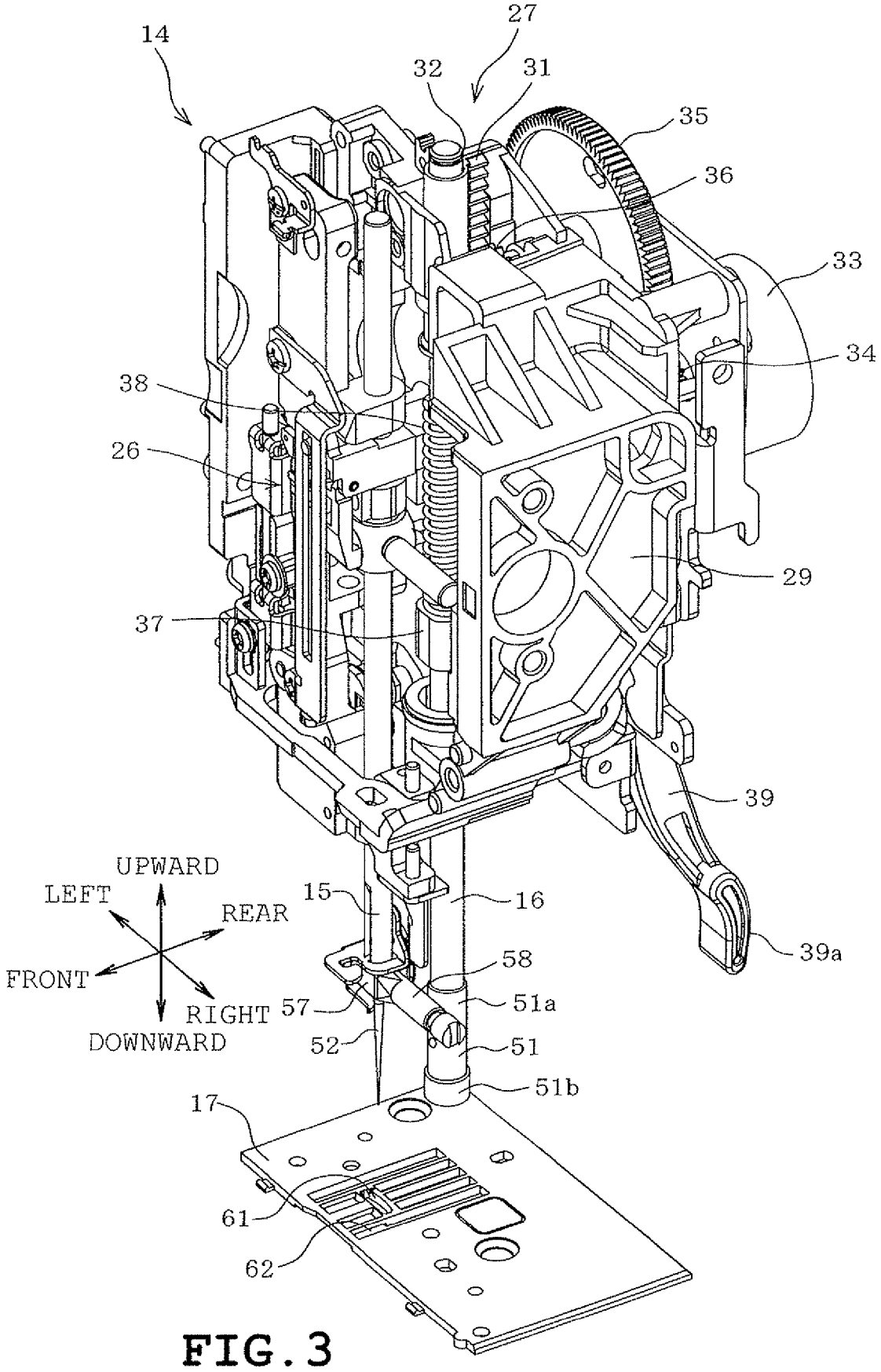
FIG. 3 is a general perspective view of a needle-bar lifting/lowering mechanism and presser-bar lifting/lowering mechanism provided within a head of the sewing machine.

As typically shown in FIGS. 1 and 2, sewing machine 10 includes components such as bed 11, pillar 12, arm 13, head 14, needle bar 15 shown in FIG. 3, and presser bar 16 shown in FIGS. 2 and 3. Pillar 12 extends upward from the right end of bed 11 and has arm 13 extending leftward over bed 11 from its upper end. The left end of arm 13 terminates into head 14. Referring to FIG. 3, bed 11 is provided with needle plate 17 which is coplanar with its upper surface. Bed 11 contains, below needle plate 17, a shuttle hook mechanism not shown, and a feed mechanism not shown. The shuttle hook mechanism has a bobbin not shown being wound with bobbin thread detachably attached to it. The feed mechanism is responsible for driving a feed dog not shown for transferring a workpiece cloth also not shown. On the front face of pillar 12, a liquid crystal display 18 hereinafter also referred to as LCD 18 is provided, whereas on the lower front face of arm 13, various switches such as sew start switch 21, sew end switch 22, and presser foot lifting/lowering switch 23 are provided.

At the upper portion of arm 13, openable/closable cover 24 is attached that extends substantially throughout the entire length of arm 13 in the left and right direction. Cover 24 is opened/closed through rotation about a rotational shaft not shown provided at the upper rear end portion of arm 13 to open/close the upper portion of arm 13. Arm 13 contains, under cover 24, a thread storage not shown that stores thread spool not shown wound with needle thread.

As can be seen in FIG. 3, head 14 contains sewing machine frame 29 that supports needle bar 15 so as to be reciprocable up and down. Needle bar 15 is reciprocated up and down by needle bar vertically moving mechanism 26. Needle bar vertically moving mechanism 26 is driven by sewing machine motor 30 shown in FIG. 4 by way of a sewing machine drive mechanism (not shown) that is provided with components such as a main shaft not shown. Sewing drive mechanism will not be described in detail because it employs a well known configuration.

Figure 4:
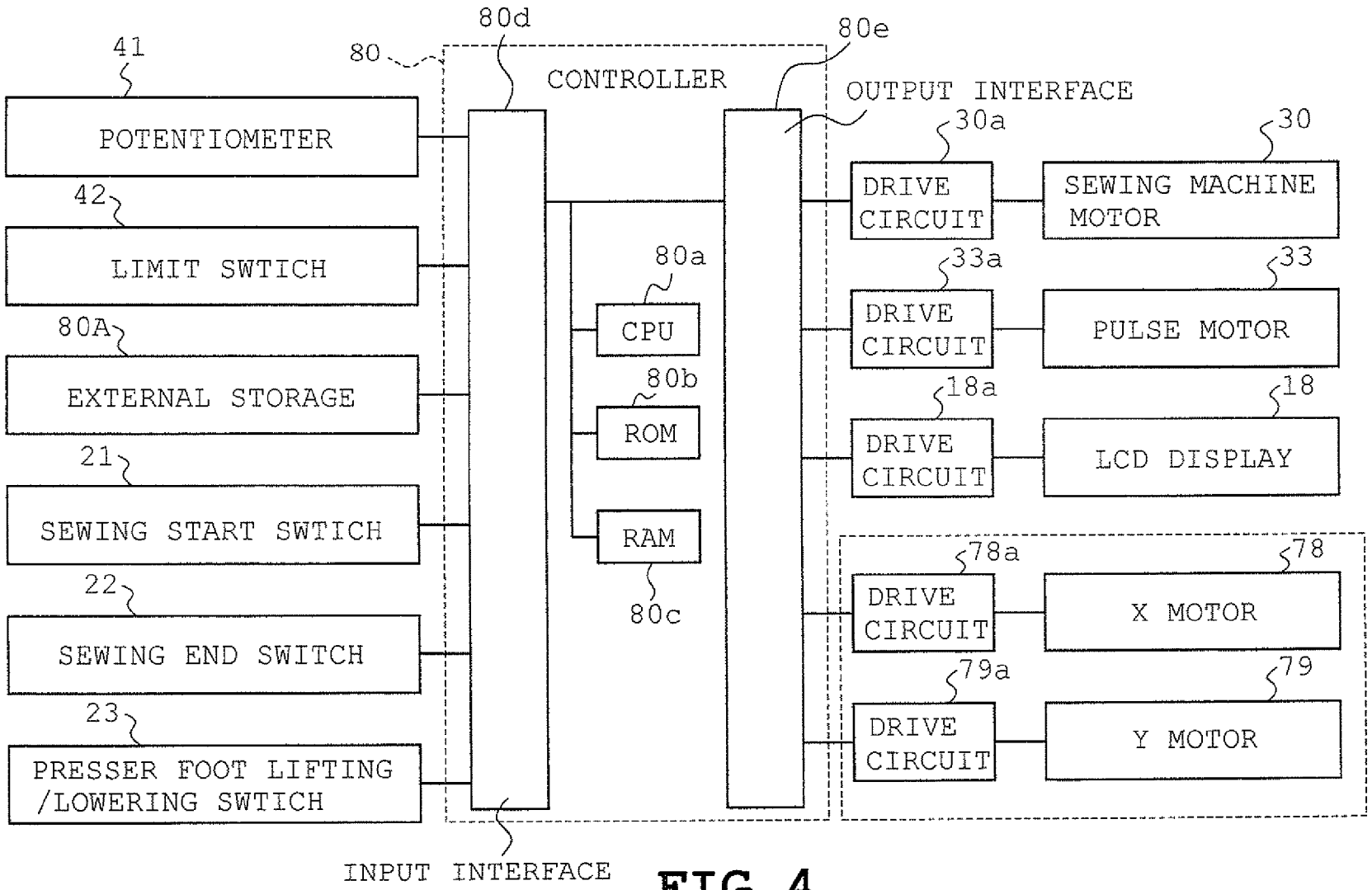
FIG. 4 is a block diagram indicating an electric configuration of the sewing machine.

As shown in FIG. 3, behind needle bar 15, presser bar lifting/lowering mechanism 26 is provided that drives presser bar 16 up and down. Presser bar lifting/lowering mechanism 27 includes components such as rack 31, stop ring 32, pulse motor 33, drive gear 34, intermediate gear 35, pinion gear 36, presser bar clamp 37, presser bar 16, press spring 38, presser foot lifting lever 39, and potentiometer 41 as shown in FIG. 4.

As shown in FIG. 3, rack 31 is mounted on the upper end of presser bar 16 so as to be movable up and down and stop ring 32 is secured on the upper end of presser bar 16. Pulse motor 33 generates the drive force for driving needle bar 16 up and down and is secured to sewing machine frame 29 at the immediate right side of rack 31. Drive gear 34 is mounted on the output shaft not shown of pulse motor 33. Intermediate gear 35 is in mesh with drive gear 34. Pinion gear 36 is formed integrally with intermediate gear 35 and is in mesh with rack 31. Presser bar clamp 37 is secured on a vertical mid portion of presser bar 16. Press spring 38 is mounted on a portion of presser bar 16 between rack 31 and presser bar clamp 37. Presser foot lifting lever 39 is manually operated to vertically move presser bar 16 independent of the vertical movement of presser bar 16 imparted by pulse motor 33. Potentiometer 41 shown in FIG. 4 is provided on the left side of presser bar 16 and detects the vertical position of presser bar clamp 37, in other words, the vertical position of presser bar 16.

Potentiometer 41 comprises rotary potentiometer and has a lever not shown that extends rightward from a rotary shaft of potentiometer 41 that is placed in consistent contact with an upper surface of a protrusion not shown protruding leftward from presser bar clamp 37. Thus, when presser bar clamp 37 is moved up and down by the lifting/lowering of presser bar 16, the lever is swung to alter the resistance of potentiometer 41. The position of presser bar 16 is detected based on a voltage outputted depending upon the variation of the resistance.

One end of presser foot lifting lever 39 is pivoted about a pin not shown secured on sewing machine frame 29. On the other end of presser foot lifting lever 39, handle 39*a* is provided to allow manual operation by the user. By manually operating handle 39*a*, presser foot lifting lever 39 can be moved from the lowered position to the lifted position. By swinging presser foot lifting lever 39, presser bar 16 can be moved up and down without being driven by the drive force imparted by pulse motor 33. In the proximity of presser foot lifting lever 39, limit switch 42 is provided as shown in FIG. 4 that is switched on and off in coordination with the operation of presser foot lifting lever 39. Limit switch 42 is responsible for detecting the vertical position or the height of presser foot lifting lever 39.

At the lower end of presser bar 16, presser foot 51 may be detachably attached which is dedicated for punch work. When punch working with sewing machine 10, presser foot 51 is attached to the lower end of presser bar 16 to replace a normal presser foot not shown used in a normal sewing operation. Presser foot 51 is generally cylindrical in form and has an upper end that serves as adapter 51*a* for attachment with presser bar 16 and a lower end serving as a presser 51*b* which is greater in diameter than adapter 51*a*. During punch working, presser foot 51 functions as an engagement subject which is engaged with engagement hole 88*a* shown in FIG. 11 for a later described placement tray 85.

Pulse motor 33, when driven, imparts its drive force to intermediate gear 35 and pinion gear 36 to cause rack 31 to be driven up and down. When rack 31 is elevated, the upper end of rack 31 elevates stop ring 53 secured on the upper end of presser bar 16, consequently elevating presser foot 51 attached to presser bar 16. When pulse motor 33 is driven to lower rack 31, press spring 38 placed in contact with the lower end underside of rack 31 is pressed downward. Thus, presser bar clamp 37 secured on presser bar 16 is pressed downward to cause presser foot 51 to be lowered toward needle bar 17. As described above, presser bar 16 having presser foot 51 attached to it is driven up and down so as to reciprocate between the upper position and the lower position by pulse motor 33. The upper position indicates the uppermost end of the reciprocable range of presser bar 16, whereas the lower position indicates the lowermost end of the reciprocable range.

Needle bar 15 allows selective and detachable attachment of a sewing needle not shown or punch needle 52 shown in FIG. 3 at its lower end. When executing a sewing operation with sewing machine 10, sewing needle not shown is attached to the lower end of needle bar 15, whereas punch needle 52 is attached at the lower end of needle bar 15 when executing a punch working operation. Punch needle 52 is attached to needle bar 15 by way of needle clamp 57. Punch Needle 52 is attached to the lower end of needle bar 15 by tightening screw 58 of needle clamp 57. Punch needle 52 is bar shaped and has an upper end attached to needle bar 15 by way of needle clamp 57, whereas the lower end terminates into a sharp pointed needle. Unlike the sewing needle, the tip of punch needle 52 does not have a needle eye. Needle bar 15 is reciprocated up and down between the upper position and the lower position by the drive force imparted by sewing machine motor 30 by way of needle bar vertically moving mechanism 26. The upper position indicates the uppermost end of the reciprocable range of needle bar 15, whereas the lower position indicates the lowermost end of the reciprocable range.

Needle plate 17 is provided on the upper surface of bed 11 at a position opposing the lower ends of needle bar 15 and presser bar 16. Needle plate 17 has a needle hole 61 formed on the line of extension from needle bar 15. Thus, as needle bar 15 is lowered, sewing needle not shown enters needle hole 61 and exits needle hole 61 as needle bar 15 is elevated. Needle plate 17 is further provided with square holes 62 through which the feed dog, not shown, protrudes and retracts. When punch working, the feed dog is maintained at a position that does not protrude from the upper surface of needle plate 17 by a feed dog lowering mechanism not shown.

Sewing machine 10 according to the present exemplary embodiment is provided with transfer device 72 that transfers workpiece W in the X and Y directions as can be seen in FIGS. 1 and 2. Transfer device 72 is provided with components such as carriage 73, X-direction transfer mechanism 74, and Y-direction transfer mechanism 75. X-direction transfer mechanism 74 is contained in casing 76 of transfer device 72 detachably attached to bed 11. Y-direction transfer mechanism 75 is located immediately above casing 76 and is contained in cover 77. Carriage 73 allows detachable attachment of a later described holder frame 81 and thereby holds holder frame 81 over bed 11. Y-direction transfer mechanism 75 transfers carriage 73 in the front and the rear direction represented as the Y-direction. X-direction transfer mechanism 74 is provided below Y-direction transfer mechanism 75 and transfers carriage 73 as well as Y-direction transfer mechanism 74 in the left and right direction represented as the X-direction.

As shown in FIG. 4, X-direction transfer mechanism 74 is provided with X motor 78 that drives Y-direction transfer mechanism 75 in the X direction. Similarly, Y-direction transfer mechanism 75 is provided with Y motor 79 that drives carriage 73 in the Y direction. X motor 78 is contained in casing 76 whereas Y motor 79 is contained in cover 77. X-direction transfer mechanism 74 and Y-direction transfer mechanism 75 will not be described in detail since they are known components of transfer device 72.

Next, a description will be given on a control system of sewing machine 10 with reference to FIG. 4.

Sewing machine 10 is provided with controller 80 as shown in FIG. 4. Controller 80 comprises: a microcomputer primarily configured by CPU 80*a*, ROM 80*b*, and RAM 80*c*; input interface 80*d*; and output interface 80*e*. Input interface 80*d* establishes electrical connection with external storage device 80A, switches such as sewing start switch 21, potentiometer 41, and limit switch 42. Output interface 80*e*, on the other hand, establishes electrical connection with sewing machine motor 30, pulse motor 33, liquid crystal display 18 hereinafter also described as LCD 18, and X and Y motors 78 and 79 of transfer device 72 by way of corresponding drive circuits 30*a*, 33*a*, 18*a*, 78*a*, and 79*a*. External storage device 80A is configured by nonvolatile memory such as EEPROM and hard disc drive.

ROM 80*b* stores a control program that controls sewing machine 10. The control program is a collection of programs such as a sewing program for executing a sewing operation, a punch working program for executing a punch working operation, and display control program for displaying various information on LCD 18. The control program typically stored in ROM 80*b* may also be stored in whole or in part in external storage device 80A.

Figure 5:
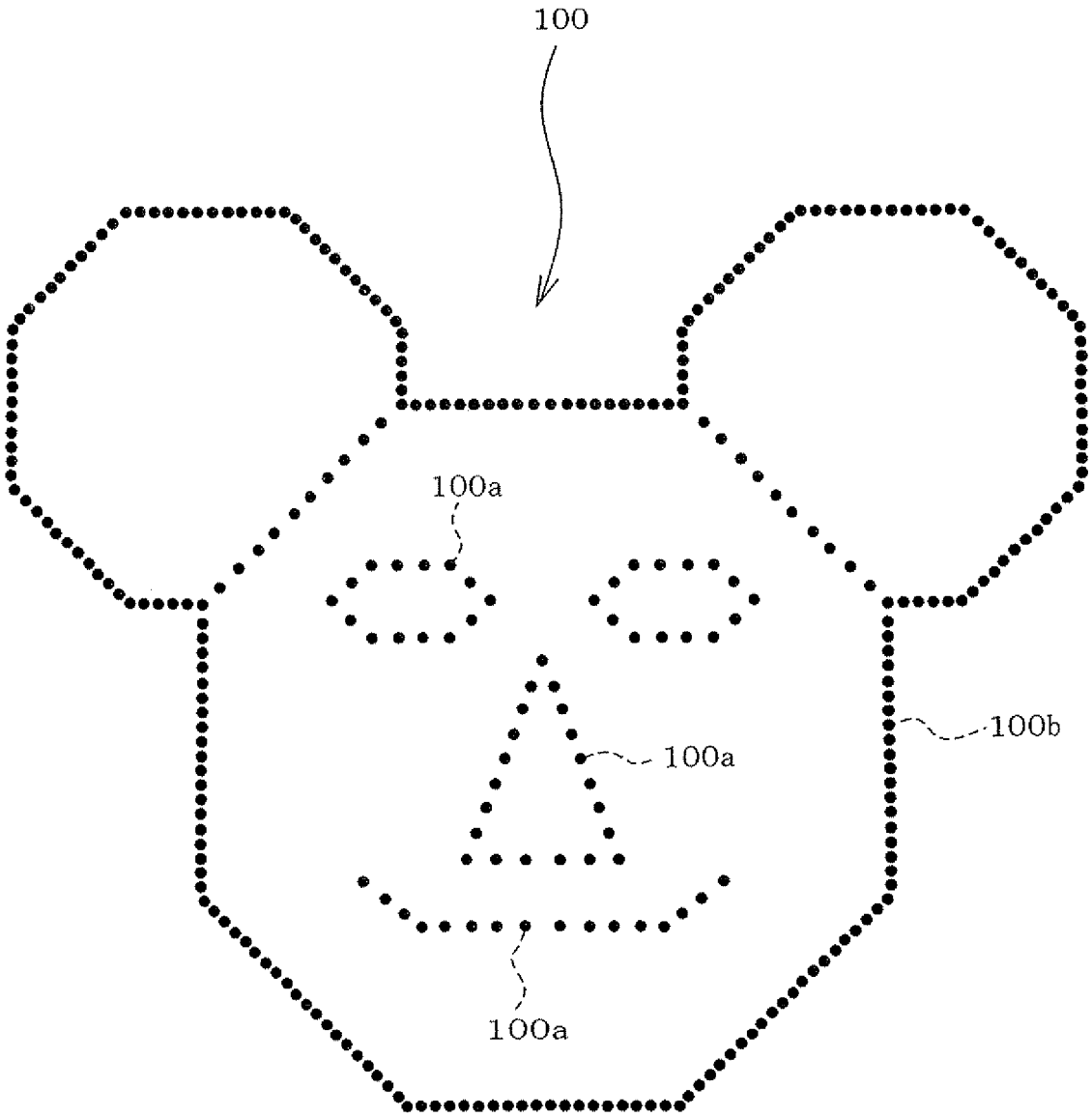
FIG. 5 shows one example of a punch work pattern.

Controller 80 controls the movement of various components, through execution of a punch working program based on punch working data of the pattern to be formed on workpiece W such as pattern 100 shown in FIG. 5. For instance, needle bar 15, presser bar 16, and holder frame 81 that supports workpiece W driven by sewing machine motor 30, pulse motor 33, and X and Y motors 78, and 79 respectively are controlled by controller 80. Controller 80 specifies the amount of up and down movement needle bar 16, that is, the distance traveled by needle bar 16 toward needle plate 17 based on the punch working data.

Punch working data contains draw data for punching patterns on workpiece W and cut data for cutting workpiece W. The draw data specifies the spatial interval between each of the needle drop points, in other words, the punch pitch to be relatively wider as compared to the corresponding punch pitch specified by the later described cut data. Sewing machine 10 is allowed to draw patterns as such exemplified by pattern line 100*a* on workpiece W without cutting apart workplace W through execution of punch working based on the draw data. As described earlier, the cut data specifies relatively narrower punch pitch as compared to the draw data. Thus, sewing machine 10 forms cut lines such as cut line 100*b* exemplified in FIG. 5 on workpiece W for cutting the drawn pattern through execution of punch working based on the cut data. Punch working executed as described above allows cutting of patterns drawn on workpiece W or forming of perforations on workpiece W to allow the drawn pattern to be cut or torn apart.

Next, the configuration of holder frame 81 will be described with reference to FIGS. 6 to 12.

Referring to FIGS. 6 to 10, holder frame 81 is configured by lower frame 82, upper frame 83, connecting element 84, and placement tray 85.

Figure 6:
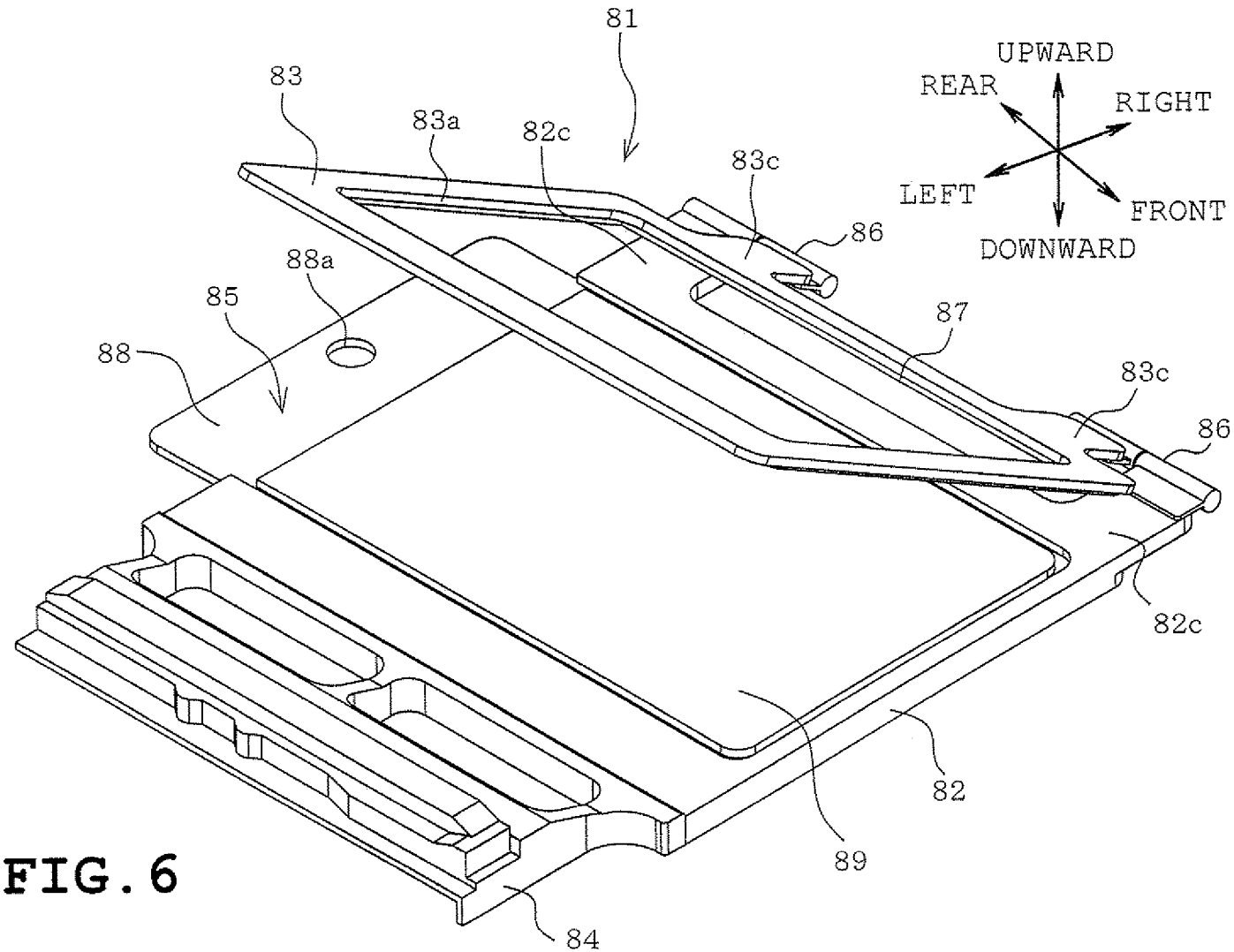
FIG. 6 is a general perspective view of a holder frame.

Lower frame 82 serves as the base of holder frame 81 and is made of a metal plate such as an iron plate. Lower frame 82 is rectangular and has an enclosed bottom surface. The framed portion residing on the bottom surface is arranged such that one of its shorter sides, the rear side, in the example shown in FIGS. 1 and 6, is opened. On the inner peripheral portion of the enclosed three sides of the framed portion which are the front, the left, and the right sides in FIGS. 1 and 6, groove 82*a* is defined.

Figure 8:
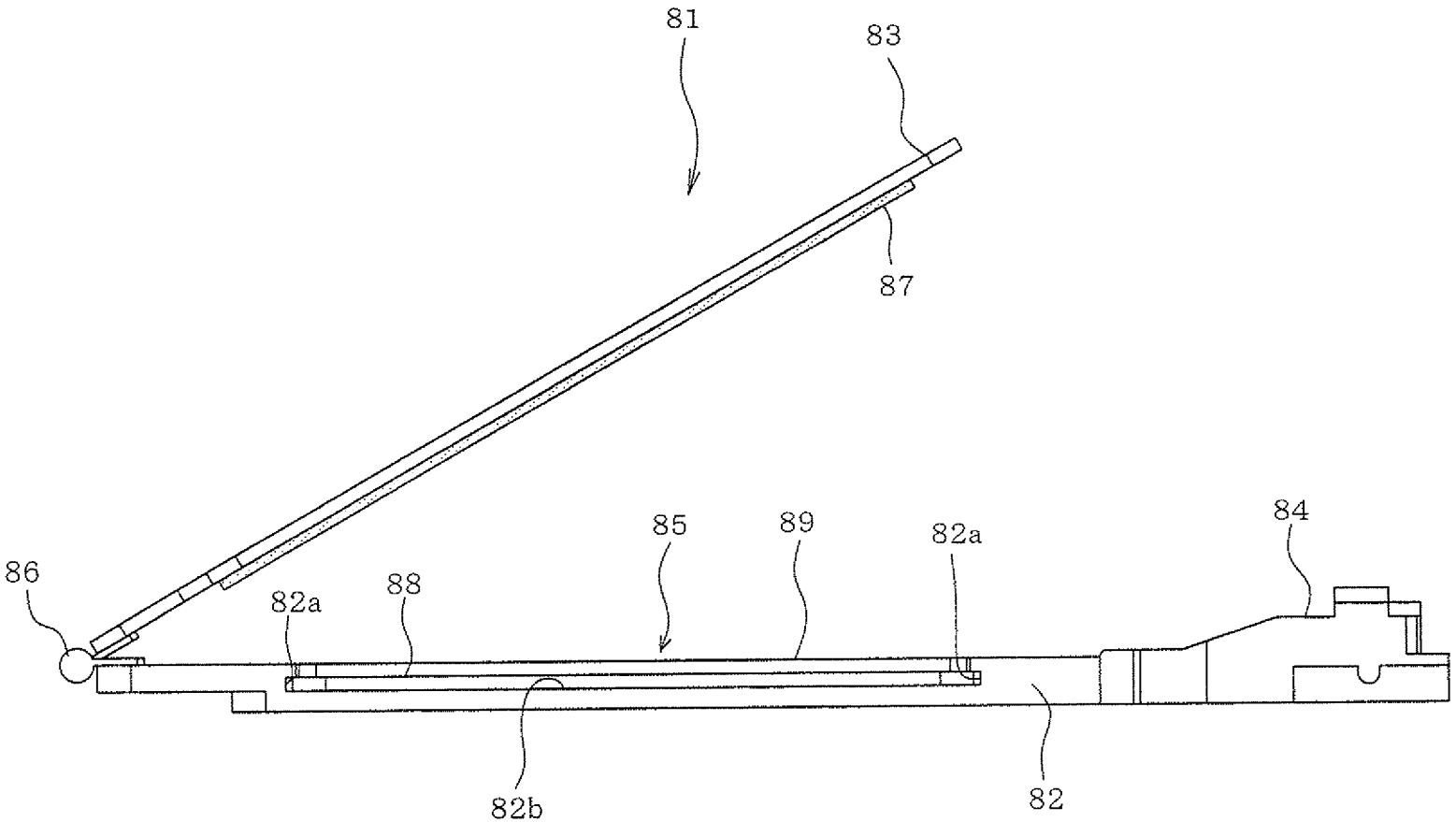
FIG. 8 is a rear side view of the holder frame with the upper frame in the release position.
Figure 9:
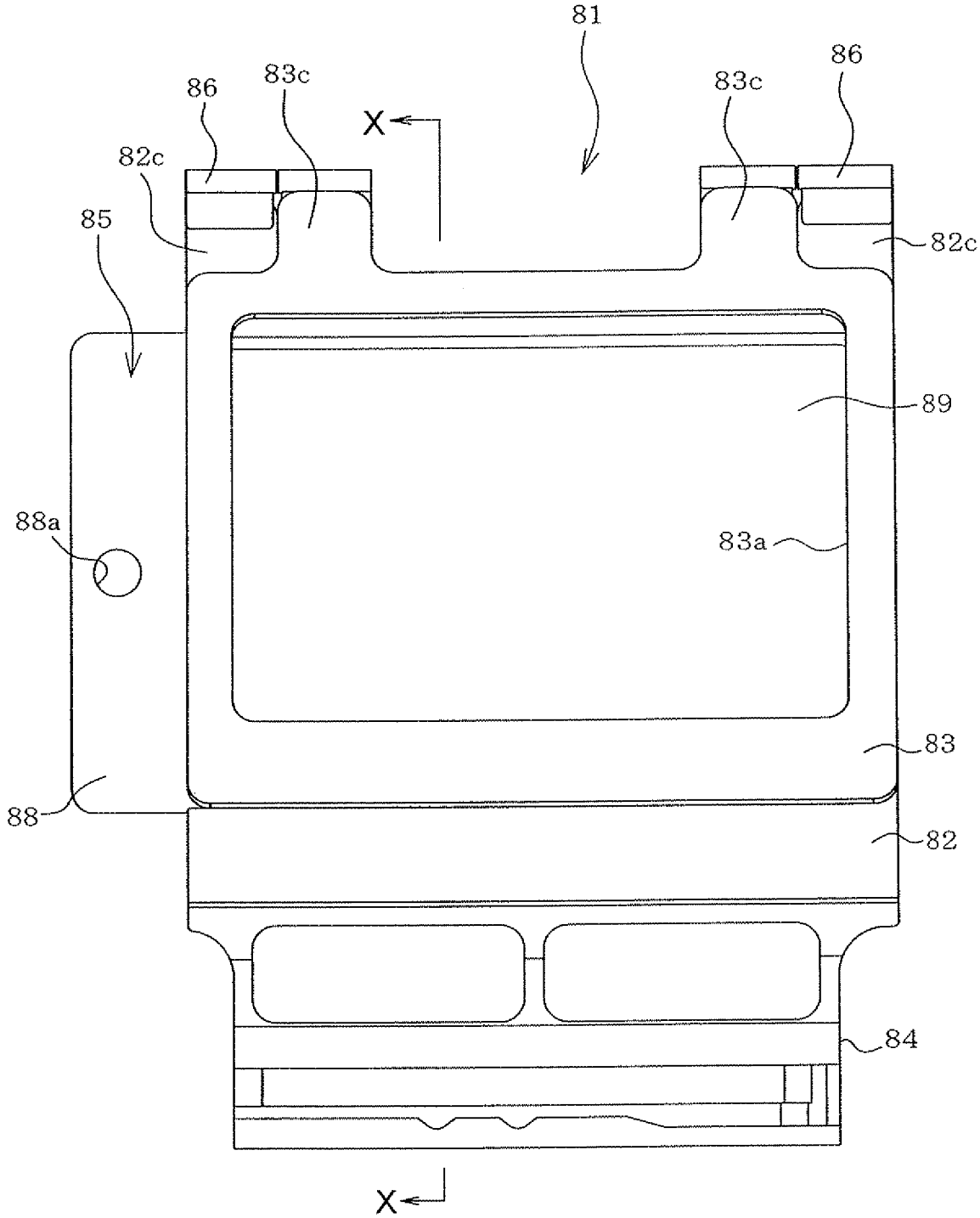
FIG. 9 is a top view of the holder frame with the upper frame in the release position.
Figure 10:
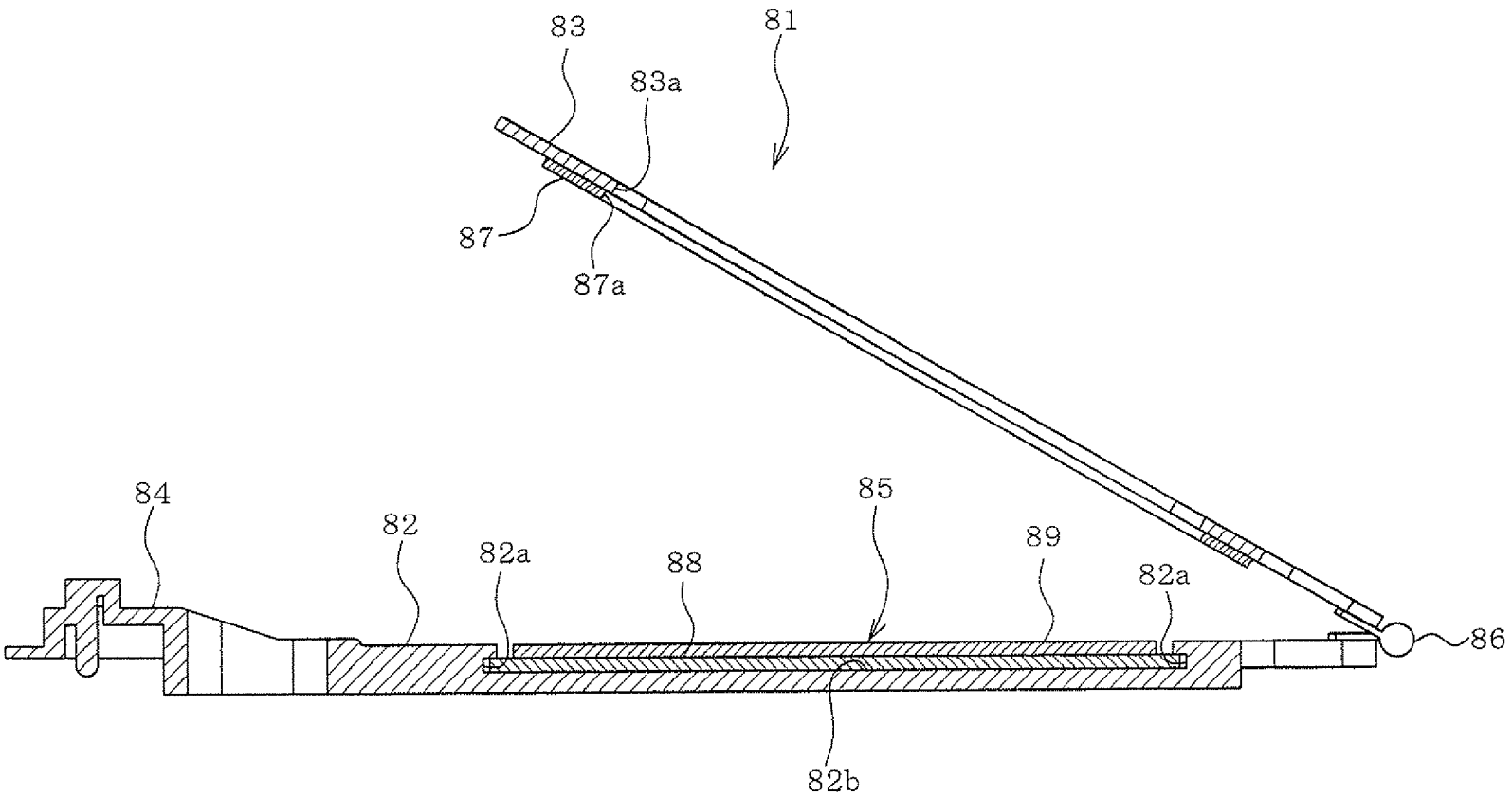
FIG. 10 is a cross sectional view of the holder frame taken along line X-X of FIG. 9.

Thus, the framed portion with one open side and the three enclosed sides having inner peripheral groove 82*a* defined on them constitute support section 82*b*. Support section 82*b* is substantially centered on lower frame 82 as shown in FIGS. 8 and 10. Support section 82*b* allows insertion of a later described placement tray 85 for the purpose of supporting placement tray 85. On one of the longer sides of lower frame 82 which is the right side in FIGS. 1 and 6, a pair of extensions 82*c* is provided so as to be located at each lengthwise end of the longer sides.

Upper frame 83 is configured as a rectangular frame made of metal plate having a middle opening 83*a*. The pair of extensions 83*c* is formed on one of the longer sides of upper frame 83 which is the right side in FIGS. 1 and 6 so as to be located inward relative to the lengthwise ends of the longer sides of upper frame 83. The pair of extensions 83*c* of upper frame 83 and the pair of extensions of 82*c* of lower frame 82 are coupled by clamp 86. To elaborate, upper frame 83 and lower frame 82 are rotatably coupled by way of clamp 86 at one of the longer sides, in this case, the right side in FIGS. 1 and 6.

Thus, upper frame 83 and lower frame 82 can be pivoted to a clamp position shown in FIG. 1 placed in contact with lower frame 82 to clamp workpiece W in a secure hold and to a release position shown in FIG. 6 separated away from lower frame 82 to release the hold of workpiece W. As further shown in FIG. 7, on the bottom surface of upper frame 83, magnet 87 is attached that has a middle rectangular opening 87*a*. Because opening 87*a* of magnet 87 is greater in dimension as compared to opening 83*a* of upper frame 83, the upper surface of magnet 87 is fully covered by upper frame 83. Upper frame 83 on which magnet 87 is attached may be made of nonmetal material such as resin.

Connecting element 84 is made of resin material and is detachably attached to carriage 73 of transfer device 72. Connecting element 84 is fastened by a screw not shown, for instance, on the remaining other longer side of lower frame 82 which is the left side in FIGS. 1 and 6 in the opposite side of clamp 86. Thus, holder frame 81 is held over bed 11 through detachable attachment of connecting element 84 with carriage 73 of transfer device 72.

Figure 11:
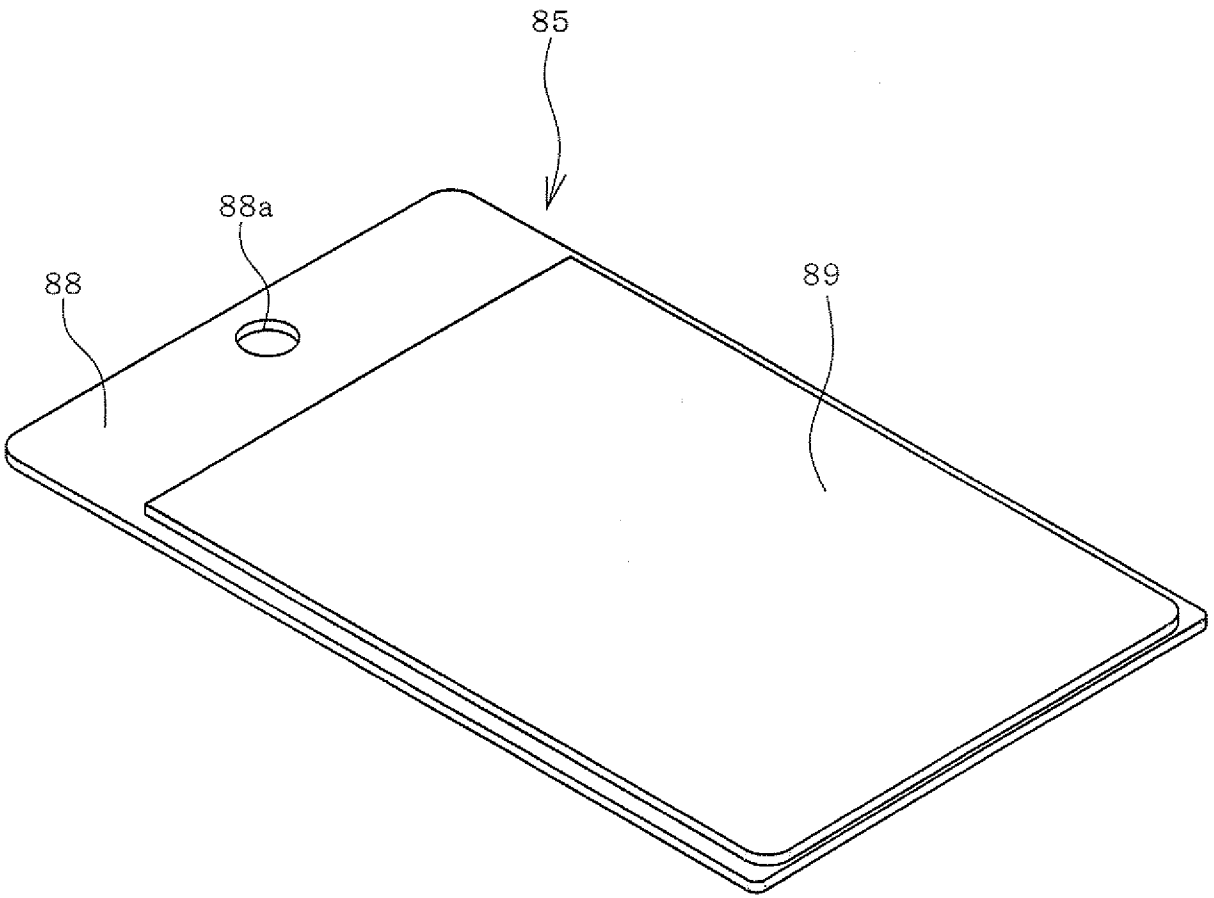
FIG. 11 is a general perspective view of a placement tray.

As can be seen in FIG. 11, placement tray 85 is configured by a panel 88 and placement 89 smaller in size than panel 88. Panel 88 is made of materials such as resin and metal. One of the shorter sides of panel 88 which is the rear side in FIGS. 1, 6, and 11 has a round engagement hole 88*a* located in its lateral middle.

Placement 89 attached to the upper surface of panel 88 is made of an elastic material like urethane foam, rubber or other flexible material which possesses a level of elasticity to absorb the impact of punch needle 52 tip. Placement 89 is affixed to panel 88 by adhesives such as double stick tape and is affixed by a level of adhesion that would allow the user to peel it off by hand from placement 89. Alternatively, placement 89 may be detachably attached to panel 88 by fitting engagement.

Figure 12:
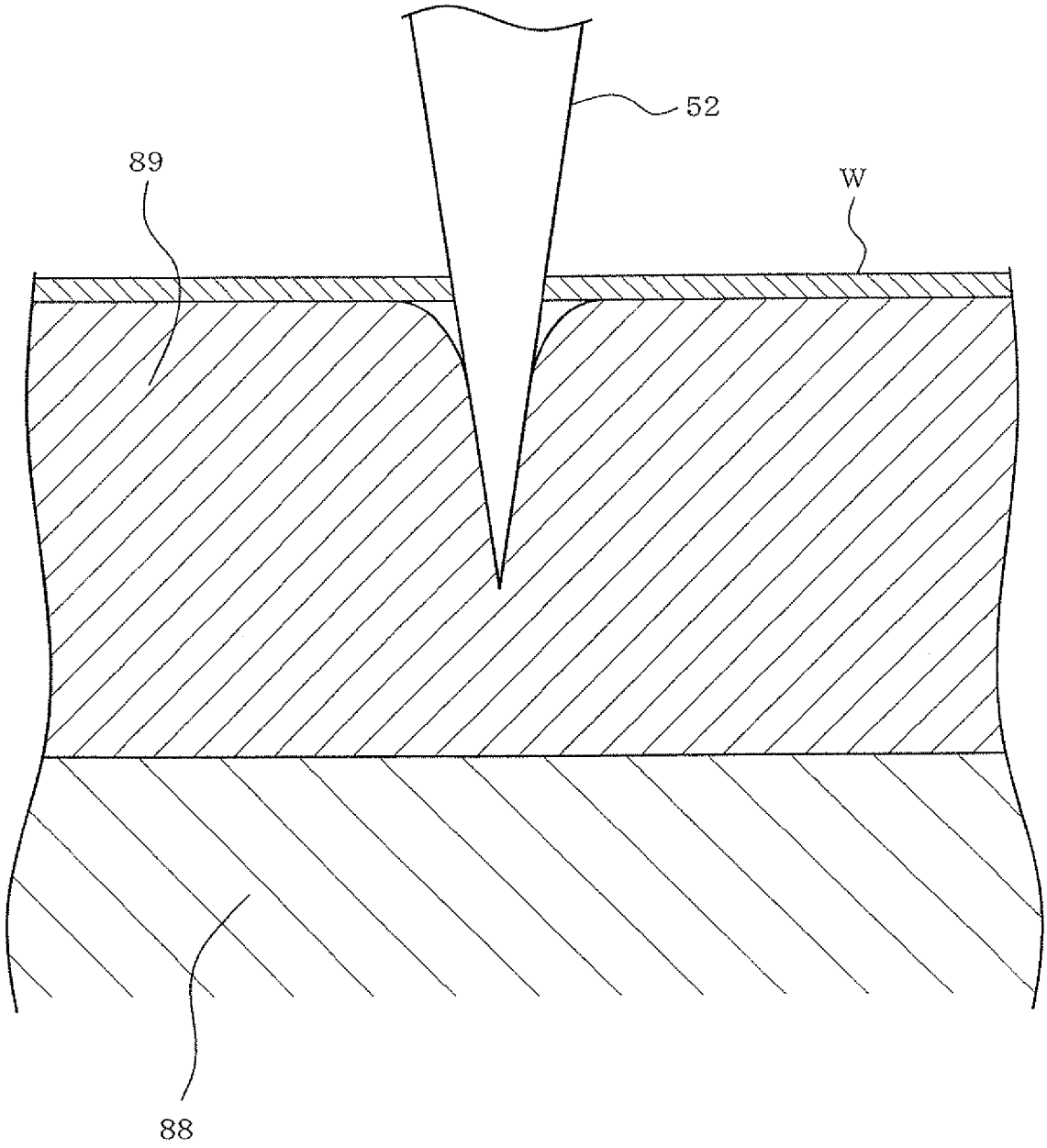
FIG. 12 is a cross sectional view of the tip of a punch needle and its peripheral portions when a needle bar is in the lowermost point of its reciprocation.

As shown in FIG. 12, the thickness of placement 89 is configured such that when needle bar 15 is at the lowermost point of its reciprocation, the tip of punch needle 52 penetrates workpiece W but does not reach or is above the bottom surface of placement 89 and the upper surface of panel 88. This means that when needle bar 15 is at the lowermost point of its reciprocation, punch needle 52 penetrates workpiece W overlying placement 89 but does not penetrate placement 89.

Placement tray 85 thus configured is removably inserted into support section 82*b* of lower frame 82 to be supported from below. Placement tray 85, when inserted into support section 82*b* is allowed to move relative to lower frame 82 along support section 82*b*. Though movable, forces not limited to friction between the edge of panel 88 and groove 82*a* running through lower frame 82 and friction between panel 88 and support section 82*b* of lower frame 82 prevents unintended displacement of placement tray 85 along support section 82*b* when impacted during the later described punch work. Placement 89 of placement tray 85 is located substantially at the longitudinal and lateral center of lower frame 82. Placement 89 and is coplanar with the portions of lower frame 82 surrounding it, in this case, the three enclosed sides with the exception of the opened side.

In operation, holder frame 81 thus configured is opened by the user as illustrated in FIG. 6 by moving upper frame 83 away from lower frame 82 to the release position. Placement tray 85 may be preset to lower frame 82 or may be inserted into lower frame 82 after opening upper frame 83 to the release position. Then, the user is to place workpiece Won placement 89 of placement tray 85 and close upper frame 83 as illustrated in FIG. 1 toward lower frame 82 to the clamp position. Upper frame 83 being thus placed over workpiece W overlying placement 89 clamps workpiece W with lower frame 82.

Lower frame 82 is made of a metal plate and upper frame 83 has magnet 87 attached to it. Thus, when upper frame 83 is closed to the clamp position, magnet 87, exerting magnetic attraction, retains the clamp position with workpiece W clamped between upper frame 83 and lower frame 82. Workpiece w, when clamped by holder frame 81, has its punch workforce placed on placement 89 exposed through opening 83*a* of upper frame 83.

Figure 13:
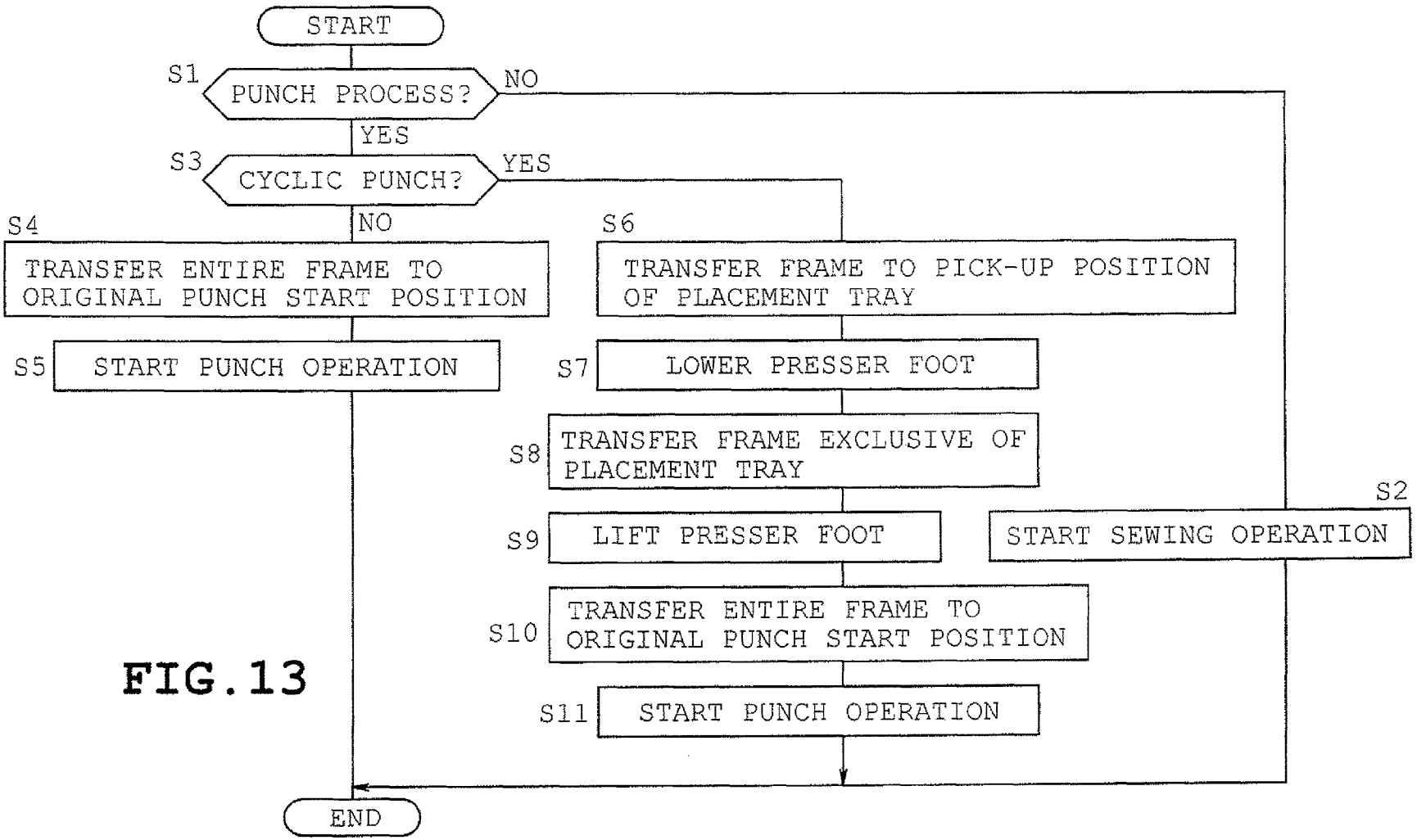
FIG. 13 is a flowchart indicating the process flow of a punch working operation executed by the sewing machine.

Next, the process flow of punch work process executed by sewing machine 10 and holder frame 81 thus configured will be described through flowchart of FIG. 13.

The punch work process begins with step S1 in which controller 80 of sewing machine 10 determines whether or not punch working mode is set. Controller 80 is configured to determine the mode setting because, as mentioned earlier, sewing machine 10 is also capable of executing the normal sewing operation under the sewing mode. When in the punch working mode, punch needle 52 are attached to needle bar 15 and presser foot 51 is attached to presser bar 16, whereas in the sewing mode, sewing needle not shown is attached to needle bar 15 and presser foot not shown for use in normal sewing operation is attached to presser bar 16. Further, when in the sewing mode, thread spool not shown wound with needle thread and a bobbin not shown wound with bobbin thread is attached to sewing machine 10 which are not used when in the punch working mode. Thus, when in the punch working mode, controller 80 ignores the outputs from a needle-thread amount sensor not shown that determines the presence/absence of needle thread and a bobbin-thread amount sensor also not shown that determines the presence/absence of bobbin thread. Transfer device 72 is attached to sewing machine 10 when in the punch working mode. When in the sewing mode, transfer device 72 is attached to sewing machine 10 in executing the embroidery sewing operation and detached from sewing machine 10 when executing the normal sewing operation other than the embroidery sewing operation.

Controller 80, when determining that punch working mode is not specified (step S1: No), proceeds to step S2 that executes the normal sewing operation. When determining that punch working mode is specified (step S1: Yes), controller 80 further proceeds to step S3 to determine whether or not the specified punch working mode is a "cyclic punch mode". The "cyclic punch mode" forms identical punch work, that is, identical patterns and cut lines on each of the multiple workpiece W.

When determining that "cyclic punch mode" is not set (step S3; No), controller 80 executes a static mode, which does not allow movement of placement tray 85 more specifically placement 89, whenever punch working is executed. Static mode begins with step S4 in which controller 80 moves holder frame 81 to the original punch start position. When holder frame 81 is moved to the original punch start position, the original start position of punch working specified in the punch working data resides immediately below punch needle 52. Controller 80, then, proceeds to step S5 which starts punch work operation based on punch working data.

When controller 80, on the other hand, determines that "cyclic punch mode" is specified (step S3; Yes), dynamic mode is specified in which placement tray 85, more specifically, placement 89 is moved whenever punch working is executed. The dynamic mode begins with step S6 that moves holder frame 81 to the pick-up position. When holder frame 81 moves to the pick-up position, engagement hole 88*a* of placement tray 85 resides immediately below presser foot 51. Then, controller 80 proceeds to step S7 which lowers presser foot 51 for engagement with engagement hole 88*a*.

Then, controller 80 proceeds to step S8 in which holder Frame 81 is moved. At this instance, because presser foot 51 is engaged with engagement hole 88*a*, placement tray 85 is anchored in place at the pick up position. Thus, when controller 80 moves holder frame 81, components such as lower frame 82 and upper frame 82 are moved whereas placement tray 85 supported movably relative to lower frame 82 stays put.

Figure 14:
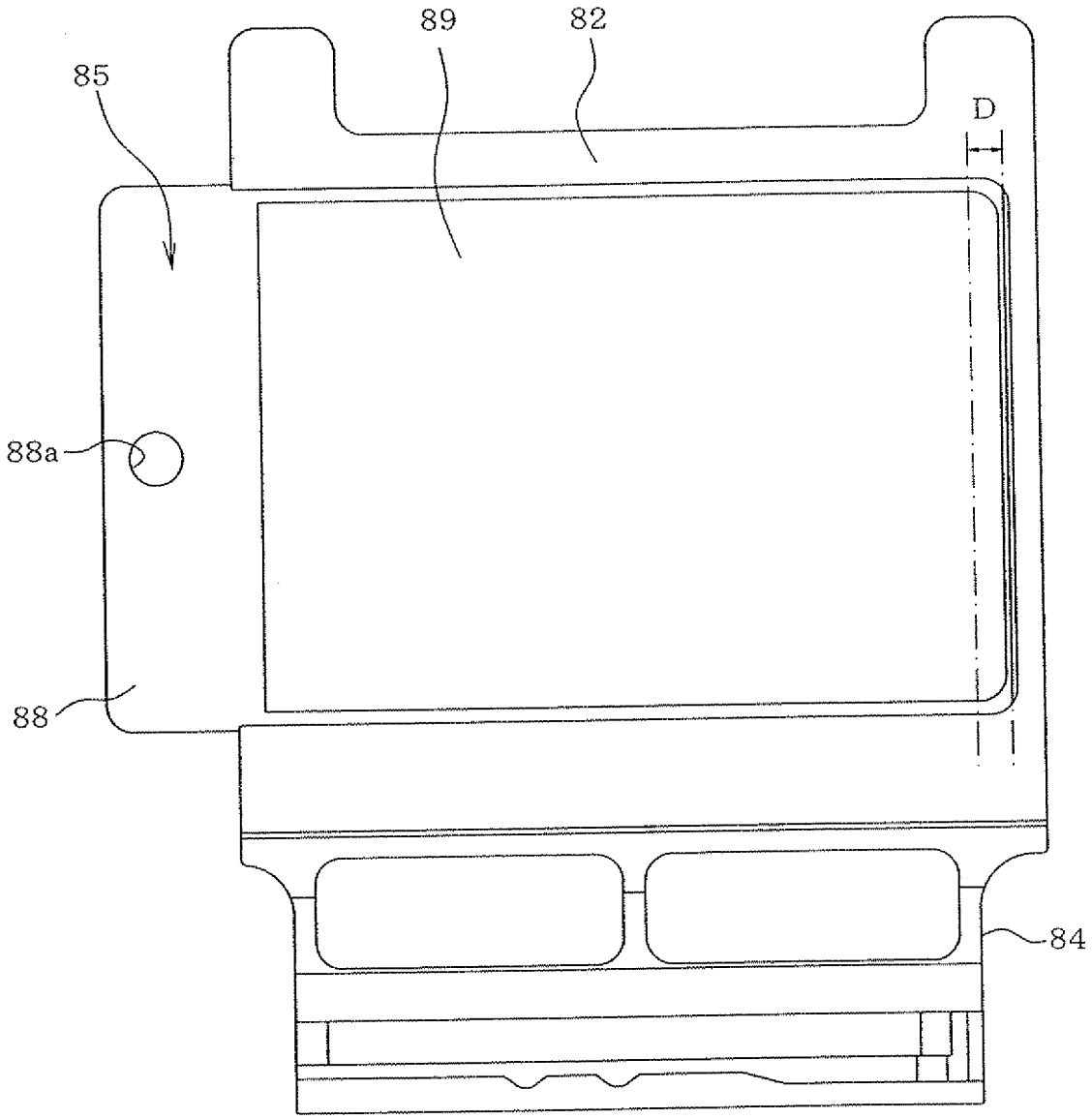
FIG. 14 is a top view of a lower frame and its peripheral portions prior to movement of the placement tray.
Figure 15:
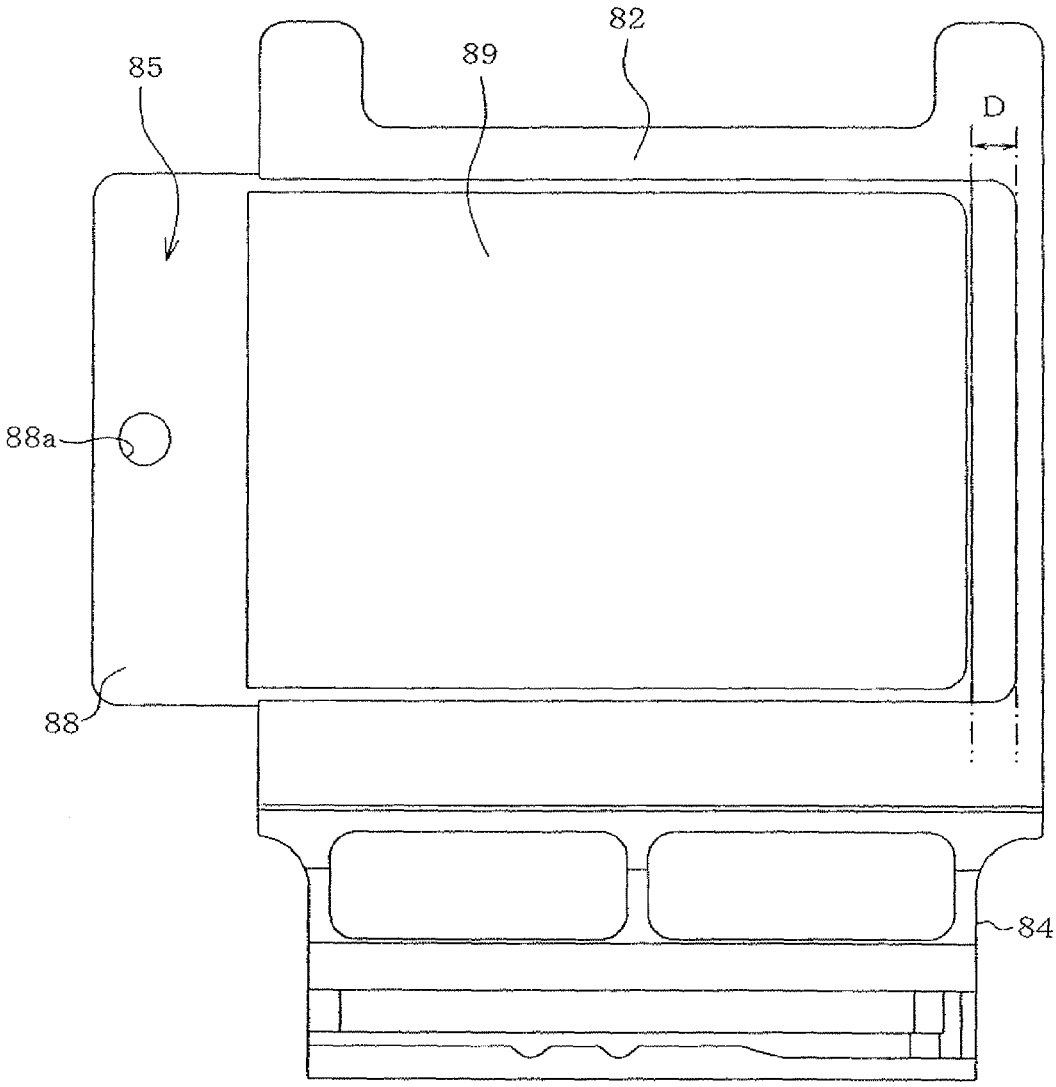
FIG. 15 is a top view of the lower frame and its peripheral portions after the movement of the placement tray.

To elaborate, placement tray 85 and more specifically placement 89 inserted into lower frame 82 as illustrated in FIG. 14 is moved relative to lower frame 82 as illustrated in FIG. 15. FIG. 15 shows placement 89 and more generally placement tray 85 moved reward (leftward in FIGS. 14 and 15) by a predetermined distance D measuring 0.5 mm, for instance, relative to lower frame 82 as compared to the positioning shown in FIG. 14 in which placement tray 85 is fully inserted into lower frame 82. For better visibility and understanding, predetermined distance D indicated in FIGS. 14 and 15 is not drawn to scale but is somewhat exaggerated. Predetermined distance D, or the movement amount of placement 89 may be a preset parameter in the control program or may be variably specified by controller 80 or the user when moving placement 89.

Next, controller 80 proceeds to step S9 in which presser foot 51 is elevated to be disengaged from engagement hole 88*a*. Then, controller 80 proceeds to step S10 in which holder frame 81 is transferred to the original punch start position and further to step S11 in which punch work operation is started based on punch work data.

When controller 80 thus configured determines that the punch work mode is set to "cyclic punch mode" (step S3: Yes), executes the dynamic mode in which placement 89 is moved upon each iteration of the cyclic execution of the punch working operation. When, controller 80, on the other hand, determines that the punch work mode is not set to "cyclic punch mode" (step S3: No), executes the static mode in which placement 89 is not moved whenever punch working is executed. This means that controller 80 is capable of mode switching between the dynamic mode and the static mode. A control for user manual operation may be provided for effecting the switch between the dynamic mode and the static mode.

The above described first exemplary embodiment in operation yields the following advantages.

Workpiece W which is worked on by punch needle 52 is placed on top of placement tray 85 and more specifically on placement 89 which is supported by lower frame 82 and portions exclusive of the workface is clamped against lower frame 82 by upper frame 83. Upper frame 83 maintains the clamping of workpiece W by the magnetic attraction exerted by magnet 87. The above described configuration advantageously allows easy and reliable hold of workpiece W with holder frame 81.

Holder frame 81 thus configured can be readily attached to transfer device 72 and more specifically to carriage 83 of sewing machine 10 by way of connecting element 84 with workpiece W retained by it. The attached holder frame 81 is thus moved as desired in the two predetermined directions, in this case, the X direction and the Y direction.

Holder frame 81 thus configured is suitable as an element for holding workpiece W in punch working workplace W using an embroiderable sewing machine 10.

Placement 89 is formed by an elastic material which is capable of absorbing the impact of punch needle 52 tip, to advantageously prevent breaking and bending of punch needle 52.

Magnet 87 provided at upper frame 83 attracts lower frame 82. Such configuration allows workpiece W to be held even more reliably by simply providing magnet 87.

Magnet 87 need not be formed as a rectangular frame, but will suffice if partially provided on upper frame 83. Magnet 87 may also be formed in a U like shape, for instance, to be provided at the three enclosed sides of the framed portion on lower frame 82. Yet further, magnet 87 may be provided only on one of the four sides that reside on the opposite side of clamp 86. Still further, magnet 87 need not be proved continuously along each of the sides of upper frame 3 but may be provided intermittently. By providing magnet 87 at least partially on upper frame 83, the space occupied by magnet 87 can be minimized.

The surface of placement 89 supported substantially at the middle of lower frame 82 is configured to be coplanar with the surrounding portions of lower frame 82. Such arrangement allows workpiece W placed on placement 89 to be held without being bent.

Placement 89 is removably attached to lower frame 82. Thus, placement 89 can be replaced if it wears out over time.

Upper frame 83 which is placed over workpiece W overlying placement 89 to clamp workpiece W against lower frame 82 is revolved by way of clamp section 86 between the clamp position in which workpiece W is clamped against lower frame 82 and the release position in which clamping of workplace W is released. The above described configuration facilitates attachment and detachment of workpiece W.

The tip of punch needle 52 is arranged to stay above the bottom of placement 89. Thus, breaking, bending any other damages of punch needle 52 can be prevented.

Placement 89 of holder frame 81 is supported by lower frame 82 so as to be movable relative to lower frame 82 and is provided with engagement hole 88*a* for engagement with presser foot 51 of sewing machine 10. Sewing machine 10, on the other hand, is provided with presser-bar lifting/lowering mechanism 27 for driving presser foot 51 up and down. Controller 80 of sewing machine 10, when executing the dynamic mode for moving placement tray 85 and more specifically placement 89, engages presser foot 51 with engagement hole 88*a* provided at placement tray 85. Then, through transfer device 72, controller 80 moves holder frame 81, that is, components such as lower frame 82 and upper frame 83 exclusive of placement tray 85 by predetermined distance D relative to placement tray 85 and more specifically placement 89 which is anchored in engagement with presser foot 51. The above described configuration allows movement of placement tray 85 and more specifically placement 89 relative to lower frame 82. Thus, even if identical punch work is cyclically executed, local wear of placement 89 can be avoided.

Controller 80 of sewing machine 10 according to the first exemplary embodiment allows execution of punch work by selecting either: the dynamic mode in which placement tray 85 and more specifically placement 89 is moved; and the static mode in which placement tray 85 and more specifically placement 89 is not moved whichever is appropriate. For instance, controller 80 may select the dynamic mode to prevent local wear of placement 89 if greater importance is placed on the life of placement 89, whereas controller 80 may select the static mode to prevent precision errors such as pattern misalignment if greater importance is placed on the precision of punch work.

Free space is available beyond the three sides of holder frame 81 which are the front side, the rear side, and the left side as viewed in FIG. 6 whereas remaining one side where clamp section 86 is provided is closed off. Thus, workpiece W greater in size than holder frame 81, for instance, can be clamped between lower frame 82 and upper frame 83 to eliminate the limitation in size of holdable workpiece W.

Figure 16:
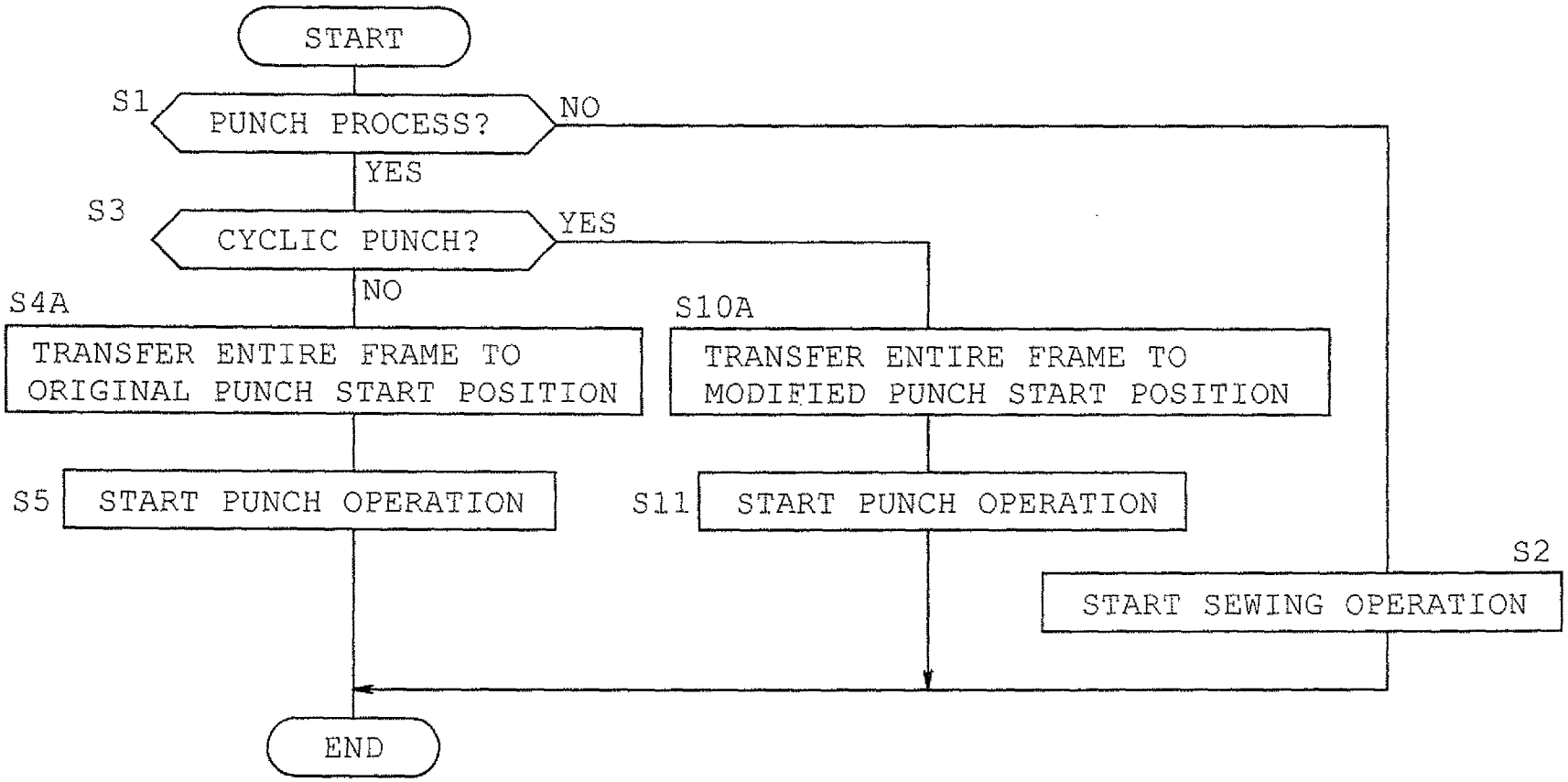
FIG. 16 corresponds to FIG. 13 and indicates a second exemplary embodiment of the present disclosure.

Next, a second exemplary embodiment will be described with reference to FIG. 16. The steps involved in the process flow of punch work in the second exemplary embodiment differ from those disclosed in the first exemplary embodiment. To summarize the difference, in the second exemplary embodiment, holder frame 81 in its entirety is moved to consequently move placement tray 85 and more specifically placement 89. The difference from the first exemplary embodiment is further described in detail in the following.

Controller 80, when determining that punch working mode is not set to "cyclic punch mode" (step S1: Yes, step S3: No) executes the static mode. At step S4A of the static mode, controller 80 moves holder frame 81 to the original punch start position originally specified in the punch working data. Then, controller proceeds to step S5 to start the punch working operation based on the punch working data.

When controller 80, on the other hand, determines that punch working mode is set to "cyclic punch mode" (step S1: Yes, step S3: Yes) executes the dynamic mode. At step S10A of the dynamic mode, holder frame 81 in its entirety is moved to a modified punch start position that is different from the original punch start position. Then, controller 80 proceeds to steps S11 in which the punch working operation is started based on the punch working data. The modified punch start position is displaced from the original punch start position by a predetermined distance. The predetermined distance, in other words, the parameters of displacement such as the amount of displacement and direction from the original punch start position may be preset in the control program or may be specified by controller 80 or by the user when moving holder frame 81.

According to the second exemplary embodiment, controller 80 of sewing machine 10, when cyclically executing identical punch work on multiplicity of workpieces W, holder frame 81 in its entirety is moved by a predetermined amount prior to execution of punch working operation by punch needle 52. Thus, even when identical punch working is executed multiple times, placement 89 can be prevented from being locally worn out.

Figure 17:
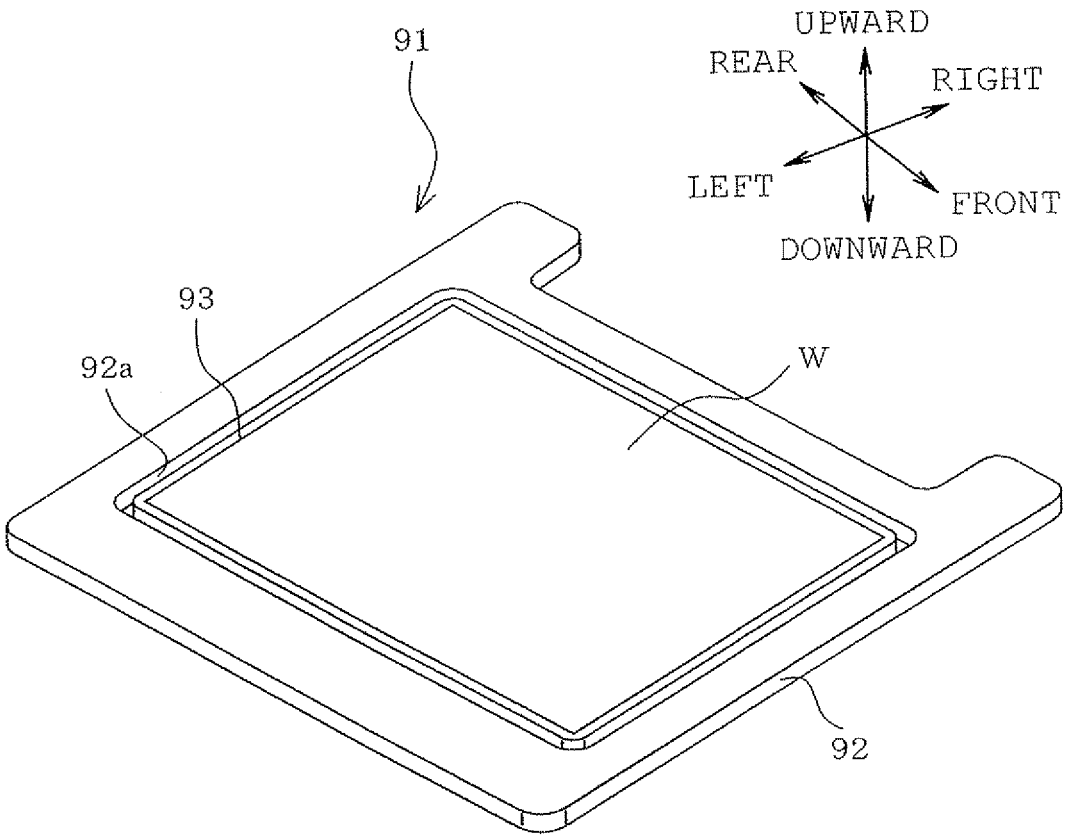
FIG. 17 corresponds to FIG. 6 and indicates a third exemplary embodiment of the present disclosure.

Next, a third exemplary embodiment of the present disclosure will be described with reference to FIG. 17. The third exemplary embodiment differs from the first exemplary embodiment in the shape of the element for holding the workpiece. The difference from the first exemplary embodiment will be described in more detail in the following.

Holder frame 91 according to the third exemplary embodiment is configured by support element 92, placement 93, and connecting element not shown.

Support element 92 acts as the base of holder frame 91 and is rectangular. Support element 92 may either be made of metal or resin. Substantially at the longitudinal and lateral center of support element 92, rectangular opening 92*a* is provided that accommodates and supports a later described placement 93.

Placement 93 is a rectangular element for placement of workpiece W. Placement 93 is affixed within opening 92*a* of support element 92 by way of adhesives such as a double stick tape by a level of adhesion that would allow the user to peel it off by hand. Placement 93 is made of adhesive elastic material which possesses a level of elasticity to absorb the impact of punch needle 52 tip and a level of adhesiveness to allow detachable attachment of workpiece W placed thereon. Thus, workpiece W is affixed on top of placement 93 by its adhesiveness which exhibits a level of adhesion that would allow the user to peel workpiece W off of placement 93 by hand.

Figure 7:
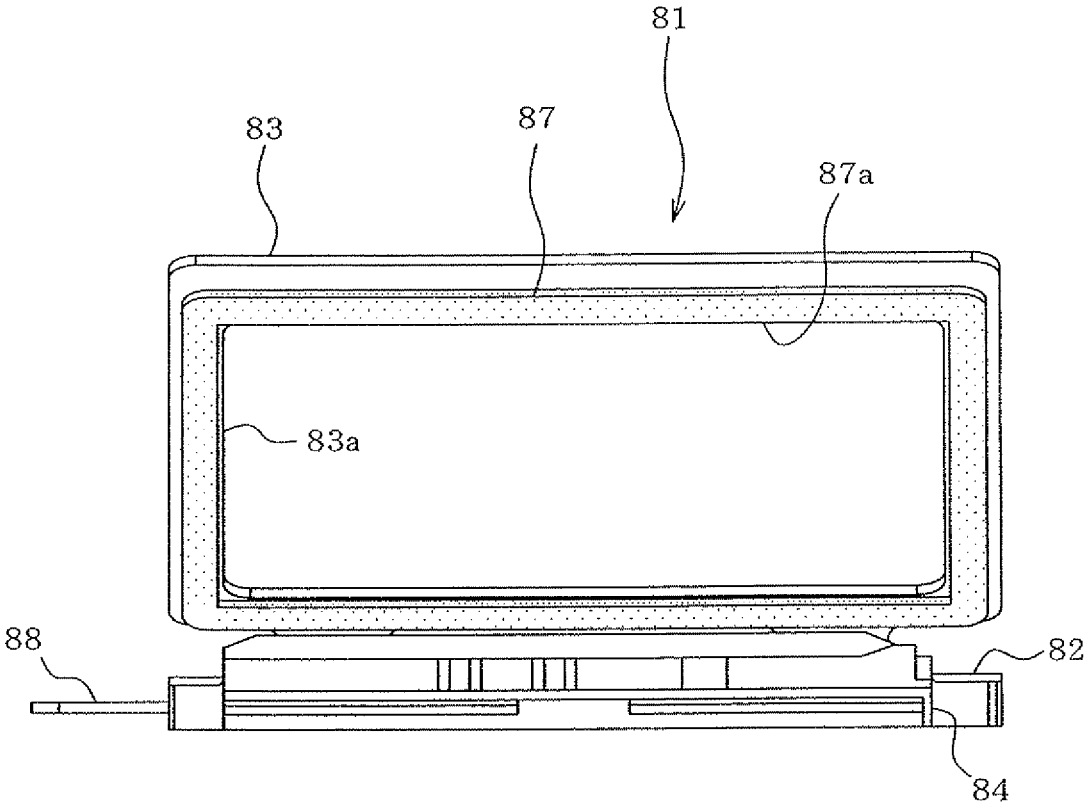
FIG. 7 is a left side view of the holder frame with an upper frame in the release position.

The connecting element is similar in configuration to connecting element 84 disclosed in the first exemplary embodiment and fastened by screw on the remaining other longer side of support element 92 which is the left side as viewed in FIG. 7. Holder frame 91 is held over bed 11 by being detachably attached to carriage 73 of transfer device 72. The connecting element may be fastened on either of the shorter sides of support element 92 which may either be the front side of the rear side as viewed in FIG. 17.

According to the holder frame 91 of the third exemplary embodiment, placement 93 supported by support element 92 is made of adhesive elastic material allowing detachable attachment of workpiece W. Thus, workpiece W can be easily and reliably held by holder frame 91 without additional provision of frame elements and retaining elements.

The above described configuration is further advantageous in that holder frame 91 can be readily attached to transfer device 72 and more specifically to carriage 73 of sewing machine 10 by way of the connecting element.

Next, a fourth exemplary embodiment of the present disclosure will be described with reference to FIG. 18. Fourth exemplary embodiment differs from the first exemplary embodiment in the shape of the element for holding the workpiece. The difference from the first exemplary embodiment will be described in more detail in the following.

Holder frame 96 is configured by frame 97 and a connecting element not shown.

Frame 97 is configured by bottom panel 97*a*, top panel 97*b*, and recess 97*c*. Bottom panel 97*a* acts as the bottom surface of frame 97 on which workpiece W is placed on and held. Top panel 97*b* has opening 97*d* defined substantially at is longitudinal and lateral middle and acts as the framed portion in rectangular shape at the upper portion of frame element 97. Opening 97*d* provided on top panel 97*b* is configured to expose the workface of workpiece W placed on bottom panel 97*a* worked on by punch work. Recess 97*c* is a shallow space defined between bottom panel 97*a* and top panel 97*b* and one of its longer sides which is the left side as viewed in FIG. 18 is opened in the form of a slit to allow the workpiece to be removably inserted into recess 97*c* to be placed on bottom panel 97*a*.

Figure 18:
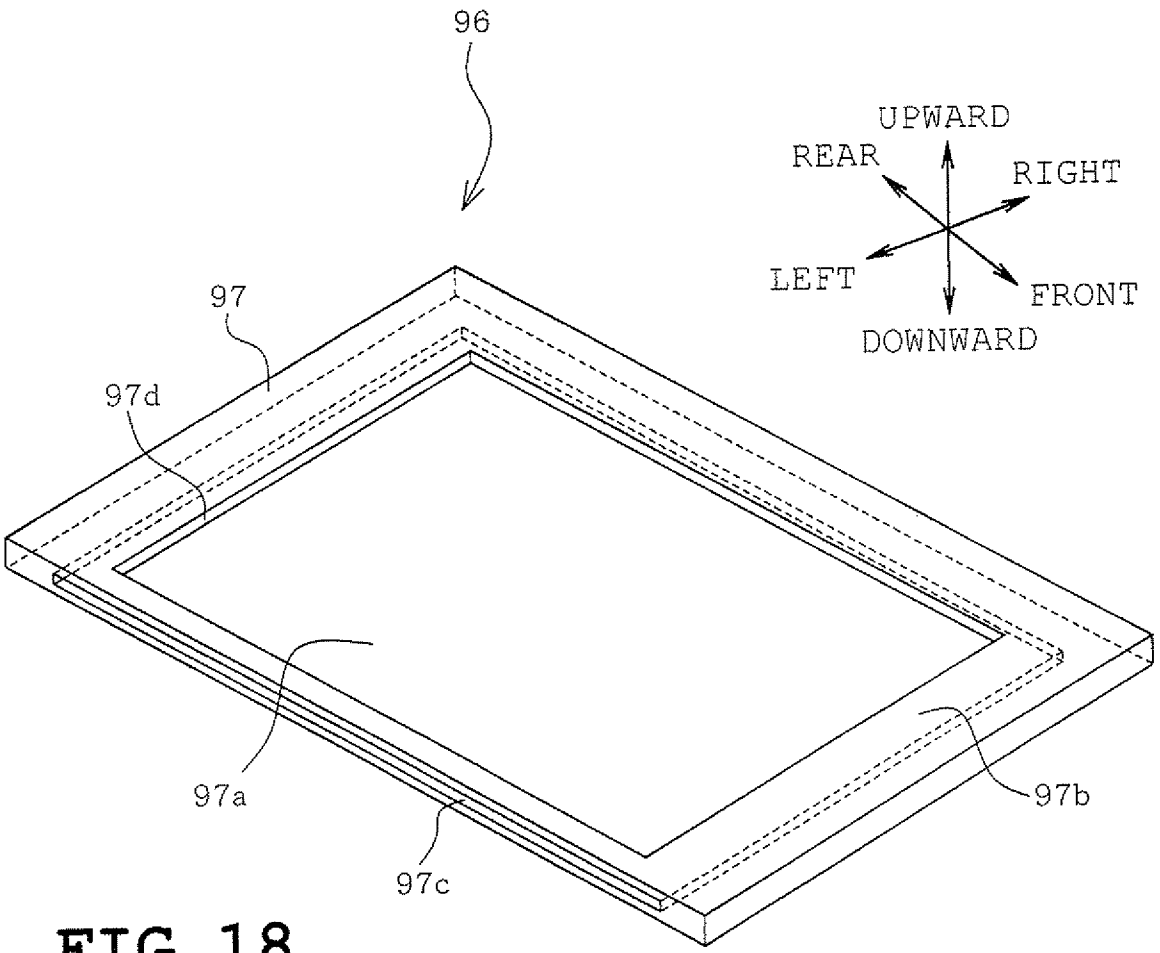
FIG. 18 corresponds to FIG. 6 and indicates fourth exemplary embodiment of the present disclosure.
Figure 19:
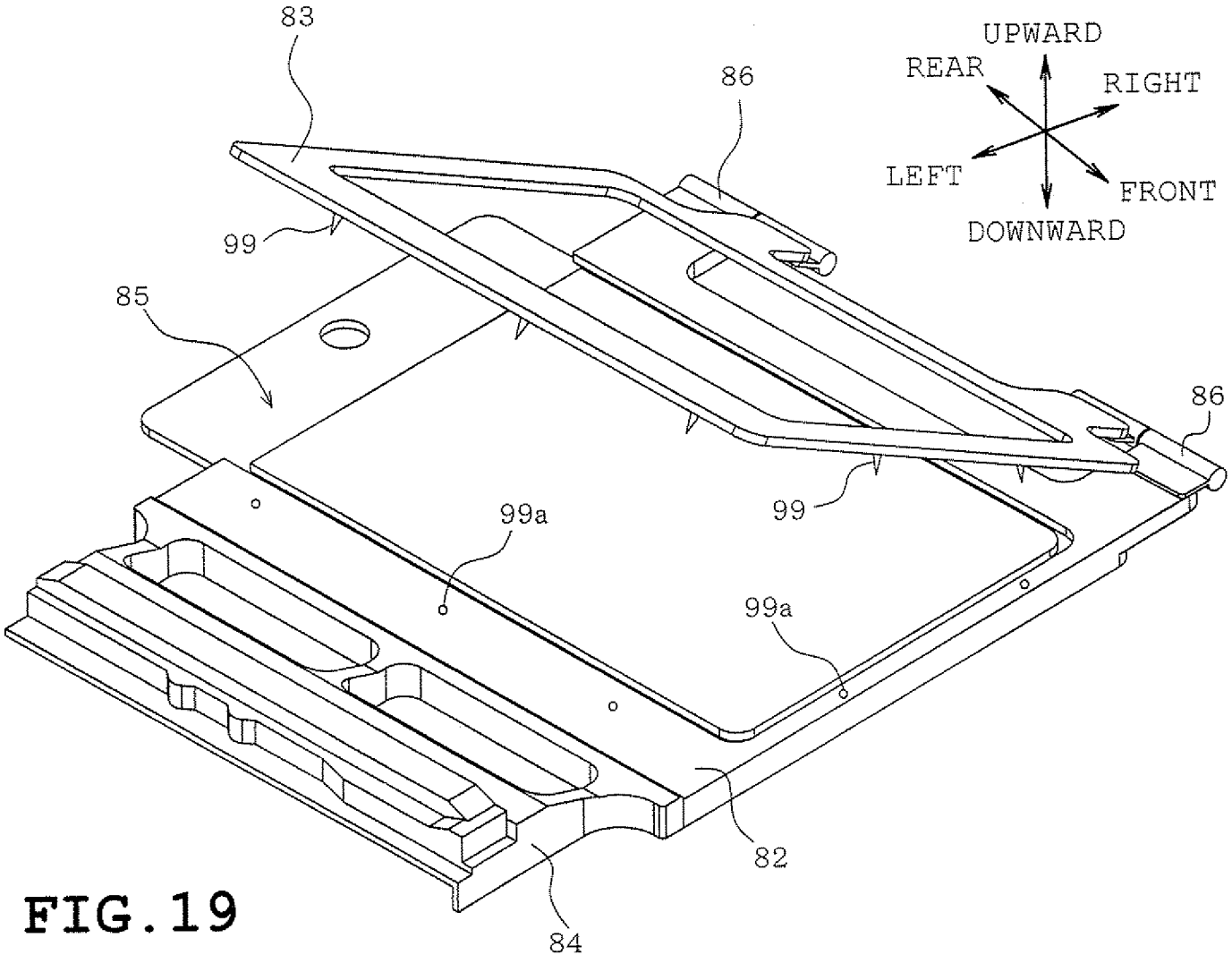
FIG. 19 corresponds to FIG. 6 and indicates a modified exemplary embodiment.

Connecting element is similar in configuration to connecting element according to the first exemplary embodiment and is secured by screw, for instance, to one of the longer sides of frame 97 which is the right side in FIG. 18 on the opposite side of the opening of recess 97*c*. Holder frame 96 is held over bed 11 by the detachable attachment of the connecting element with carriage 73 of transfer device 72. Connecting element may, for instance, be held on either of the shorter sides of frame 97 which is the front side or the rear side in FIG. 18.

According to holder frame 96 of the fourth exemplary embodiment, workpiece W is held by being inserted into recess 97*c* between bottom panel 97*a* and top panel 97*b*. The above described simplified configuration allows the placement, the support section, and the holder frame to be eliminated to facilitate and improve the reliability of the hold of workpiece W by holder frame 96.

Holder frame 96 thus configured can be readily attached to transfer device 72 and more specifically carriage 73 of sewing machine 10 by way of connecting element.

Because of, but not limited to, the advantages described above, holder frame 96 thus configured is suitable for holding workpiece W when punch working workpiece W using embroiderable sewing machine 10.

The present disclosure is not limited to the foregoing exemplary embodiments but may be subjected to various modifications and expansions.

Magnet 87 only needs to be provided on either of lower frame and upper frame 83. Thus, magnet 87 may be provided on lower frame 82 instead of upper frame 83 in which case magnet 87 attracts upper frame 83 to lower frame 83 with workpiece W clamped therebetween.

Magnet 87 may be replaced by a needle. To elaborate, a plurality of needles 99 may be provided on the underside of upper frame 83 and a plurality of mating needle holes 99*a* may be provided on lower frame 82. Under such configuration, needles 99 secure upper frame 83 against lower frame 82 with workpiece W clamped therebetween.

Holder frames 81, 91, and 96 disclosed in the foregoing exemplary embodiments may establish connection with sewing machine through various alternative mechanisms besides having its subcomponent which is connecting element 84 in this case connected to carriage 73. For instance, holder frames 81, 91, and 96 may be held at two sides by a retaining mechanism such as screw engagement which makes adjustments in the pressure exerted on the workpiece holder by tightening or loosening the screw.

The dimensions of punch needle 52 such as the length, the diameter, and the shape of the tip may be varied as appropriate depending upon application such as the material, the size or the pattern to be formed on workpiece W by punch working.

The size and the shape of holder frames 81, 91, and 96 may be varied as appropriate depending upon the size, the shape, and the material of workpiece W. Multiple types of holder frames differing in size and shape may be prepared and interchanged as required depending upon the size, the shape, and the material of workpiece W. Further, carriage 73 may be provided with a frame-type detection sensor that detects the type of holder frame attached to it by sensing the size and shape of the holder frame and allow controller 80 to control the amount and direction, etc. of movement of the holder frame during the punch work depending upon the detected frame type.

Various modifications are allowable throughout the configuration of sewing machine 10 and transfer device 72 as long as they are true to the spirit of the present disclosure.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A workpiece holder for use with an embroiderable sewing machine including a transfer device that is configured to transfer a workpiece in two predetermined directions, and a needle bar configured to have a punch needle attached thereto, the workpiece holder being attached to the transfer device and being configured to hold a workpiece on which punch work is executed by the punch needle, the workpiece holder, comprising:

a connecting element that is detachably attached to the transfer device;

a placement element that is configured to receive the workpiece;

a support element that is provided with the connecting element and that supports the placement element;

a frame element that is configured to clamp the portions of the workpiece placed on the placement element exclusive of a workface on which the punch work is executed; and a retainer element that retains the clamping of the workpiece by the frame element.

2. The workpiece holder according to claim 1, wherein the placement element comprises an elastic element capable of absorbing impacts of a tip of the punch needle.

3. The workpiece holder according to claim 1, wherein the retainer element includes a magnet provided at either of the support element and the frame element, and the magnet attracts either of the support element and the frame element to maintain the clamping of the workpiece.

4. The workpiece holder according to claim 3, wherein the magnet is provided at least on a portion of the frame element.

5. The workpiece holder according to claim 1, wherein the placement element is supported so as to be substantially centered on the support element, and the placement element and portions of the support element surrounding the placement element are substantially coplanar.

6. The workpiece holder according to claim 1, wherein the placement element is detachably attached to the support element.

7. The workpiece holder according to claim 1 further comprising a pivot element wherein the support element comprises a lower frame that supports the placement element from below, the frame element comprises an upper frame that is configured to clamp the workpiece placed on the placement element by being placed over the workpiece, and the pivot element allows the upper frame to be pivoted between a first position in which the workpiece is clamped and a second position in which the workpiece is free to move.

8. The workpiece holder according to claim 1, wherein the placement element is configured at a thickness that does not allow the tip of the punch needle penetrating the workpiece placed on the placement element to penetrate a bottom surface of the placement element.

9. A workpiece holder for use with an embroiderable sewing machine including a transfer device that is configured to transfer a workpiece in two predetermined directions, and a needle bar configured to have a punch needle attached thereto, the workpiece holder being attached to the transfer device and configured to hold a workpiece on which punch work is executed by the punch needle, the workpiece holder, comprising:

a connecting element that is detachably attached to the transfer device;

a placement element configured to receive the workpiece and that comprises an adhesive elastic element with a level of adhesiveness to allow detachable attachment of the workpiece placed thereon; and a support element that is provided with the connecting element and that supports the placement element.

10. A workpiece holder for use with an embroiderable sewing machine including a transfer device that is configured to transfer a workpiece in two predetermined directions, and a needle bar configured to have a punch needle attached thereto, the workpiece holder being attached to the transfer device and configured to hold a workpiece on which punch work is executed by the punch needle, the workpiece holder, comprising:

a connecting element that is detachably attached to the transfer device;

a frame element including a bottom panel configured to receive the workpiece, a top plate provided with an opening that is configured to expose a workface of the workpiece on which punch work is executed, and a recess that is defined between the bottom panel and the top panel to receive removable insertion of the workpiece.

11. A sewing machine allowing detachable attachment of the workpiece holder according to claim 1, the connecting element of the workpiece holder being detachably attached to the transfer device, the sewing machine comprising:

a controller, when cyclically executing identical punch work on a plurality of workpieces, that executes a dynamic mode in which the workpiece holder is moved upon each iteration of the cyclic execution of the identical punch work;

wherein the controller, when executing the dynamic mode, controls the transfer device to move the workpiece holder such that the workpiece holder is moved by a predetermined distance prior to the punch work by the punch needle.

12. The sewing machine according to claim 11, further comprising a mode switcher that allows switching between the dynamic mode and a static mode in which the placement element is not moved.

13. A sewing machine allowing detachable attachment of the workpiece holder according to claim 1, the connecting element of the workpiece holder being detachably attached to the transfer device, the sewing machine comprising:

a presser foot drive mechanism that moves a presser foot up and down;

a controller, when cyclically executing identical punch work on a plurality of workpieces, that executes a dynamic mode in which the workpiece holder is moved upon each iteration of the cyclic execution of the identical punch work;

an engagement section provided at the placement element of the workpiece holder, and that is supported so as to be movable relative to the support element as well as being capable of engaging with the presser foot;

a controller, when executing the dynamic mode, that controls the presser foot drive mechanism to lower the presser foot so as to be engaged with the engagement section of the placement element and that controls the transfer device to move the workpiece holder such that the support element is moved by a predetermined distance relative to the placement element engaged with the presser foot.

14. The sewing machine according to claim 13, further comprising a mode switcher that allows switching between the dynamic mode and a static mode in which the placement element is not moved.

* * * * *